US007165375B2

(12) United States Patent
O'Dowd

(10) Patent No.: US 7,165,375 B2
(45) Date of Patent: Jan. 23, 2007

(54) INFLATION DEVICE FOR FORMING INFLATED CONTAINERS

(75) Inventor: Robert J. O'Dowd, Wesley Hills, NY (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 105 days.

(21) Appl. No.: 11/051,204

(22) Filed: Feb. 5, 2005

(65) Prior Publication Data

US 2006/0174589 A1 Aug. 10, 2006

(51) Int. Cl.
*B65B 31/04* (2006.01)
*B65B 41/00* (2006.01)

(52) U.S. Cl. ..... 53/96; 53/89; 53/385.1

(58) Field of Classification Search ..... 53/403, 53/79, 95, 88, 89, 91, 96, 385.1; 141/114; 156/147, 156
See application file for complete search history.

(56) References Cited

U.S. PATENT DOCUMENTS

| | | | | |
|---|---|---|---|---|
| 2,265,075 | A | 12/1941 | Knuetter | |
| 2,718,105 | A | 9/1955 | Ferguson et al. | |
| 3,196,068 | A | 7/1965 | Schoder et al. | |
| 3,209,513 | A | 10/1965 | Cochrane | |
| 3,319,538 | A | 5/1967 | Bodolay et al. | |
| 3,462,913 | A | 8/1969 | Bodolay et al. | |
| 3,546,433 | A | 12/1970 | Johnson | |
| 3,596,428 | A | 8/1971 | Young et al. | |
| 3,660,189 | A | 5/1972 | Troy | |
| 3,735,551 | A | 5/1973 | Pratt | |
| 3,901,759 | A | 8/1975 | Highfield et al. | |
| 3,938,298 | A | 2/1976 | Luhman et al. | |
| 4,017,351 | A * | 4/1977 | Larson et al. | 156/494 |
| 4,096,306 | A | 6/1978 | Larson | |
| 4,169,002 | A | 9/1979 | Larson | |
| 4,201,031 | A | 5/1980 | Wiles | |
| 4,384,442 | A | 5/1983 | Pendleton | |
| 4,448,011 | A | 5/1984 | Pohl | |
| 4,509,820 | A | 4/1985 | Murata et al. | |
| 4,512,136 | A | 4/1985 | Christine | |
| 4,545,180 | A | 10/1985 | Chung et al. | |
| 4,631,901 | A | 12/1986 | Chung et al. | |

(Continued)

FOREIGN PATENT DOCUMENTS

| | | |
|---|---|---|
| EP | 0 679 588 | 11/1995 |

OTHER PUBLICATIONS

"Fill-Aire Elite", Sealed Air Corporation (Published Apr. 2004).

*Primary Examiner*—Stephen F. Gerrity
*Assistant Examiner*—Paul Durand
(74) *Attorney, Agent, or Firm*—Thomas C. Lagaly

(57) ABSTRACT

An inflation device for introducing gas into inflatable webs of the type comprising a pair of juxtaposed film plies and a pair of opposing film edges, the inflation device including a body having a longitudinal dimension, a transverse dimension, and a web-contact region in which the inflation device makes contact with opposing surfaces of the juxtaposed film plies as gas is introduced into the inflatable web, the body having at least one increase in peripheral transverse surface distance along the longitudinal dimension of the body, and a passage within the body through which gas may flow, the passage having a termination point within the web-contact region to form an inflation zone therein.

31 Claims, 22 Drawing Sheets

U.S. PATENT DOCUMENTS 4,654,878 A 3/1987 Lems
4,674,268 A * 6/1987 Gavronsky et al. ..... 53/468
4,847,126 A 7/1989 Yamashiro et al.
4,869,048 A 9/1989 Boeckmann
4,893,453 A 1/1990 Weikert
4,999,975 A 3/1991 Willden et al.
5,032,212 A 7/1991 Campbell
5,042,663 A 8/1991 Heinrich
5,067,301 A 11/1991 Shore
5,070,675 A 12/1991 Chuan-Shiang
5,080,747 A 1/1992 Veix
5,181,365 A 1/1993 Garvey et al.
5,187,917 A 2/1993 Mykleby
5,210,993 A 5/1993 Van Boxtel
5,216,868 A 6/1993 Cooper et al.
5,246,527 A 9/1993 Bjorkman et al.
5,254,074 A 10/1993 Landers et al.
5,337,539 A 8/1994 Barton
5,339,602 A 8/1994 Landers et al.
5,353,573 A 10/1994 Durrant
5,355,656 A 10/1994 Perrett
5,357,733 A 10/1994 Weikert
5,411,625 A 5/1995 Focke et al.
5,427,830 A 6/1995 Pharo
5,441,345 A 8/1995 Garvey et al.
5,454,642 A 10/1995 De Luca
5,552,003 A 9/1996 Hoover et al.
5,581,983 A 12/1996 Murakami
5,660,662 A * 8/1997 Testone ..... 156/145
5,679,208 A 10/1997 Sperry et al.
5,687,545 A 11/1997 Baker
5,693,163 A 12/1997 Hoover et al.
5,699,653 A 12/1997 Hartman et al.
5,722,217 A 3/1998 Cloud
5,733,045 A 3/1998 Jostler et al.
5,755,082 A 5/1998 Takahashi et al.
5,824,392 A 10/1998 Gotoh et al.
5,845,463 A 12/1998 Henaux
5,862,653 A 1/1999 Solano
5,873,215 A 2/1999 Aquarius et al.
5,875,610 A 3/1999 Yuyama et al.
5,918,441 A 7/1999 Baker
5,937,614 A 8/1999 Watkins et al.
5,942,076 A 8/1999 Salerno et al.
RE36,501 E 1/2000 Hoover et al.
6,035,611 A 3/2000 Lerner
6,058,681 A 5/2000 Recchia, Jr.
RE36,759 E 7/2000 Hoover et al.
6,145,273 A 11/2000 Baker
6,174,273 B1 1/2001 Harding
6,209,286 B1 4/2001 Perkins et al.
6,375,785 B1 4/2002 Aquarius
6,410,119 B1 6/2002 De Luca et al.
6,453,644 B1 9/2002 Baker
6,460,313 B1 10/2002 Cooper
6,550,229 B1 4/2003 Sperry et al.
6,582,800 B1 6/2003 Fuss et al.
6,605,169 B1 8/2003 Perkins et al.
6,635,145 B1 10/2003 Cooper
6,651,406 B1 11/2003 Sperry et al.
6,659,150 B1 12/2003 Perkins et al.
6,761,960 B1 7/2004 De Luca et al.
6,786,022 B1 9/2004 Fuss et al.
6,800,162 B1 10/2004 Kannankeril et al.
6,804,933 B1 10/2004 Sperry et al.
2002/0108352 A1* 8/2002 Sperry et al. ..... 53/403
2002/0150730 A1 10/2002 De Luca et al.
2002/0166788 A1 11/2002 Sperry et al.
2004/0206050 A1 10/2004 Fuss et al.
2005/0188659 A1* 9/2005 Lerner et al. ..... 53/469
2006/0086064 A1* 4/2006 Wehrmann ..... 53/403
2006/0090421 A1* 5/2006 Sperry et al. ..... 53/403

* cited by examiner

INFLATION DEVICE FOR FORMING INFLATED CONTAINERS

BACKGROUND OF THE INVENTION

The present invention relates to inflated containers and, more particularly, to an improved device for producing gas-inflated cushions for packaging.

Various apparatus and methods for forming inflated cushions or pillows are known. Such inflated cushions are used to package items, by wrapping the items in the cushions and placing the wrapped items in a shipping carton, or simply placing one or more inflated cushions inside of a shipping carton along with an item to be shipped. The cushions protect the packaged item by absorbing impacts that may otherwise be fully transmitted to the packaged item during transit, and also restrict movement of the packaged item within the carton to further reduce the likelihood of damage to the item. The cushions generally comprise one or more containers, into which air or other gas has been introduced and sealed closed.

Conventional machines for forming inflated cushions tend to be rather large, expensive and complex, and produce cushions at a rate which is slower than would be desired. While smaller, less-expensive inflation machines have been developed more recently, such machines tend to be inefficient and noisy. The inefficiency is a result of gas leakage, i.e., not all of the gas intended to inflate the containers actually ends up being sealed within the container because of gas leakage during inflation. This results in excess gas being used, which adds cost to the inflation operation, and also slows the rate of production. Gas leakage also contributes to an increase in noise levels during inflation.

Accordingly, there is a need in the art for in improved inflation device for introducing gas into inflatable webs, which provides for a more efficient inflation operation with less noise.

SUMMARY OF THE INVENTION

That need is met by the present invention, which, in one aspect, provides an inflation device for introducing gas into moving inflatable webs of the type that are conveyed in a forward direction along a path of travel and comprise a pair of juxtaposed film plies and a pair of opposing film edges, each film edge being associated with a respective film ply, the inflation device comprising:

a. a body having a longitudinal dimension, a transverse dimension, and a web-contact region in which the inflation device makes contact with opposing surfaces of the juxtaposed film plies, the body adapted to be positioned such that its longitudinal dimension is in general alignment with the web travel path, the body further having at least one increase in peripheral transverse surface distance along the longitudinal dimension of the body in the forward direction of web travel, the peripheral transverse surface distance being measured (i) in a direction that is substantially transverse to the longitudinal dimension of the body, and (ii) from one of the opposing film edges to the other within the web-contact region of the body; and b. a passage within the body through which gas may flow, the passage having a termination point within the web-contact region to form an inflation zone therein.

In accordance with another aspect of the invention, an inflation assembly is provided that employs an inflation device as described above, and at least one pressure member that exerts a compressive force against at least one of the film plies such that the film ply is compressed between the pressure member and a surface of the inflation device.

In an alternative inflation assembly, at least a portion of the inflation device has a convex shape such that the film ply is compressed between the pressure member and the convex surface of the inflation device.

Yet another aspect of the invention is directed to an apparatus for making inflated containers from a moving film web having two juxtaposed film plies. The juxtaposed film plies include a pair of opposing film edges, each film edge being associated with a respective film ply, and a series of containers between the film plies, with each container having at least one opening therein. The apparatus comprises an inflation assembly as described above, a mechanism that conveys the film web in a forward direction along a path of travel, and a sealing device for sealing closed the openings of the inflated containers.

These and other aspects and features of the invention may be better understood with reference to the following description and accompanying drawings.

DETAILED DESCRIPTION OF THE INVENTION

Figure 1:
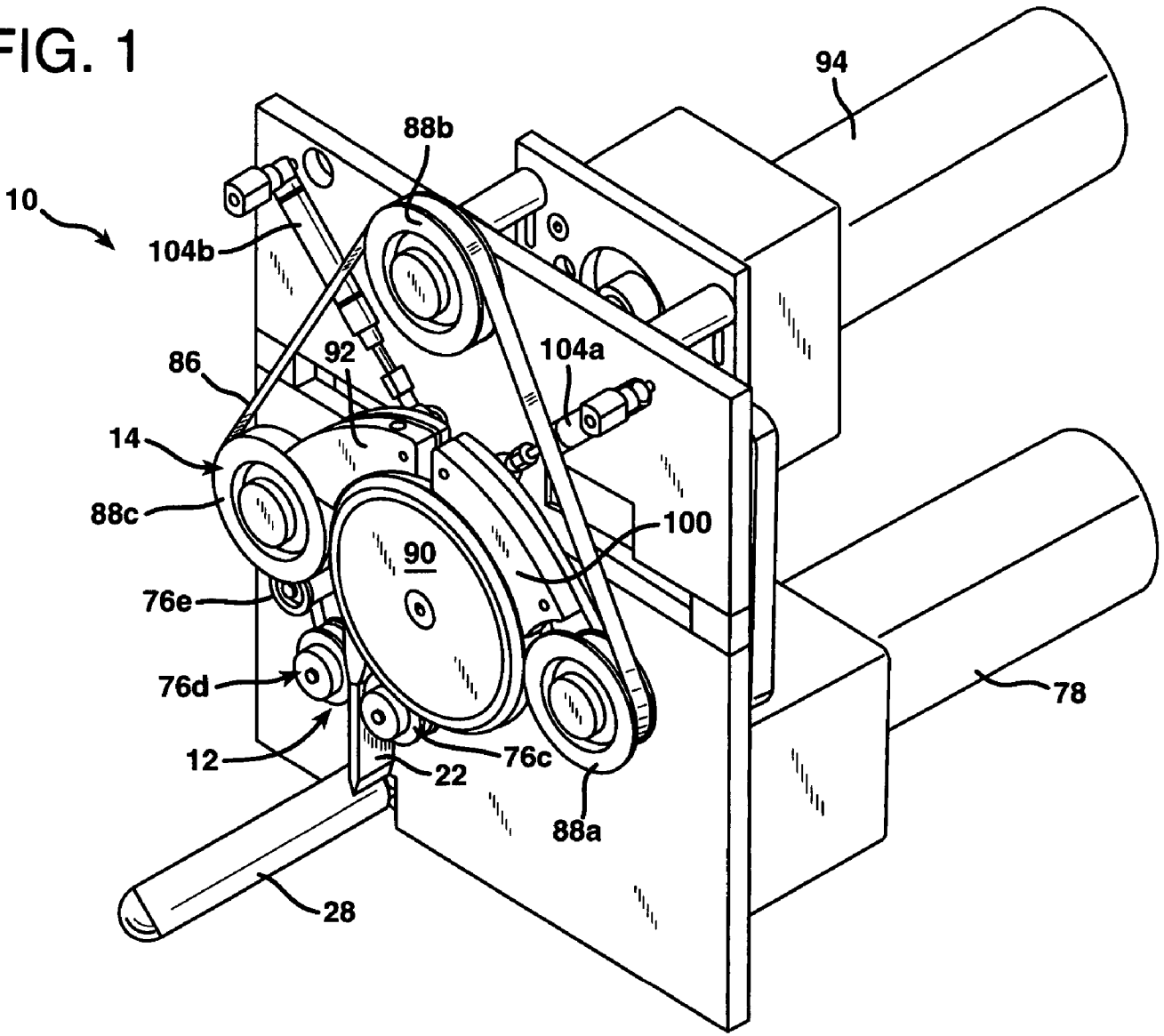
FIG. 1 is a perspective view of an apparatus for forming inflated containers, e.g., inflated cushions, in accordance with the present invention.

FIG. 1 illustrates an apparatus 10 for making inflated containers in accordance with the present invention. Such inflated containers may be used as cushions, e.g., for packaging and protecting articles during shipment and storage. Other uses for the inflated containers are also envisioned, e.g., as floatation devices or decorative articles. Apparatus 10 generally includes an inflation assembly 12 and a sealing device 14.

Figure 11:
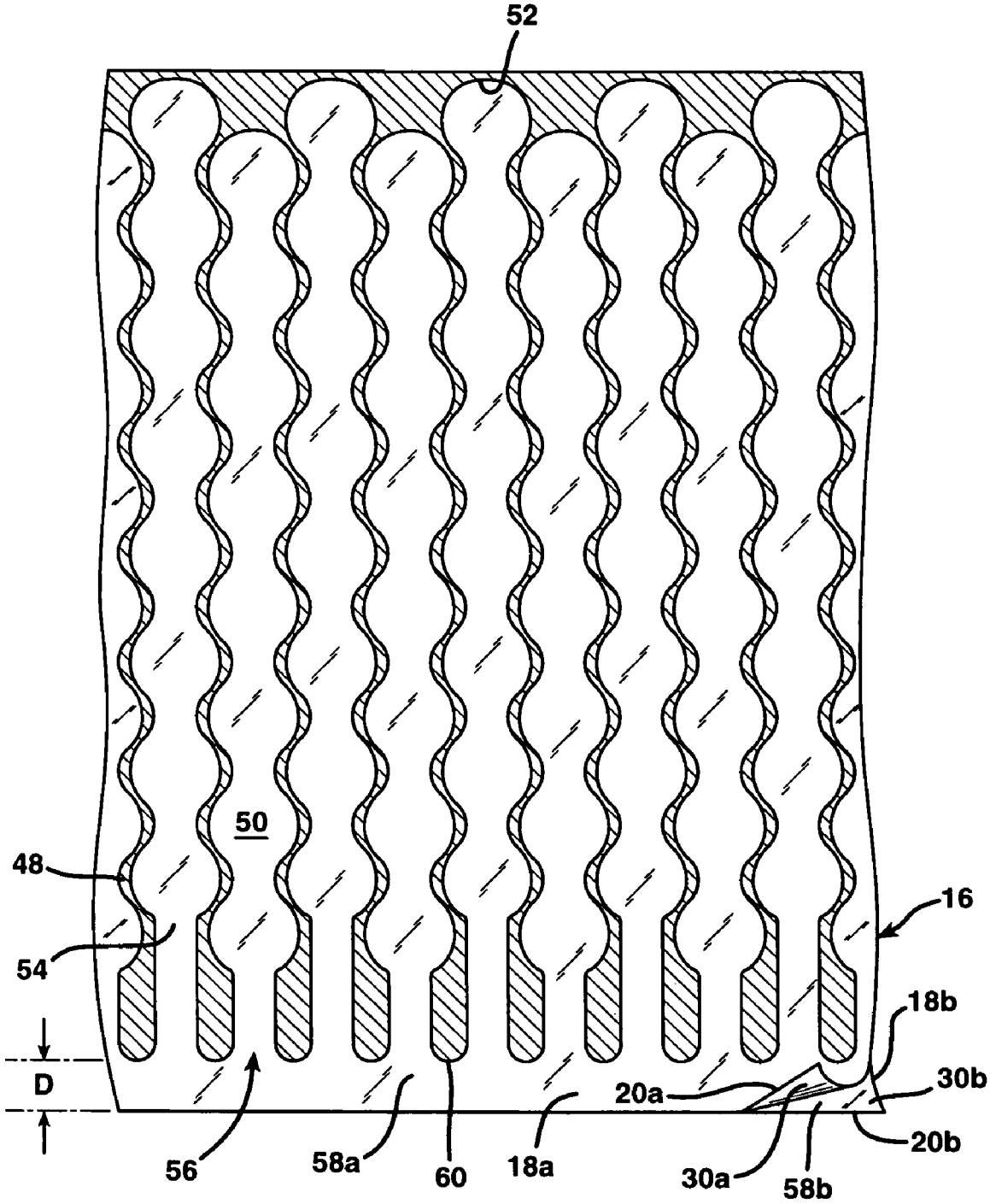
FIG. 11 is a plan view of an inflatable web that may be inflated and sealed closed in accordance with the invention.

Apparatus 10 may be used to make inflated containers from a variety of inflatable webs. A suitable inflatable web 16 is illustrated in FIG. 11, and may be of the type comprising a pair of juxtaposed film plies 18*a, b* with a pair of opposing film edges 20*a, b*, each film edge 20*a, b* being associated with a respective film ply 18*a, b*.

Figure 3:
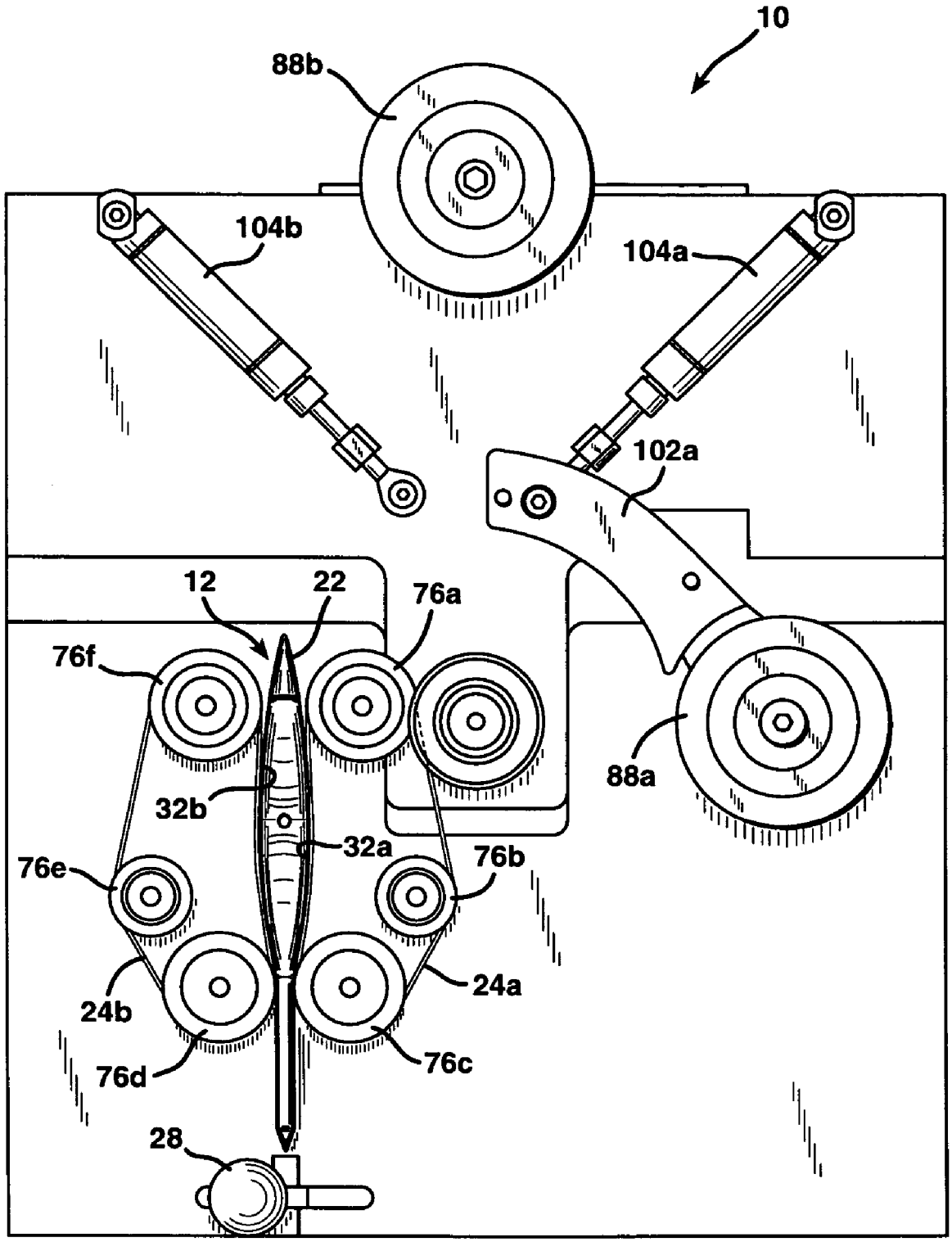
FIG. 3 is a front elevational view of the apparatus shown in FIG. 1, with some of the components removed for clarity.
Figure 4:
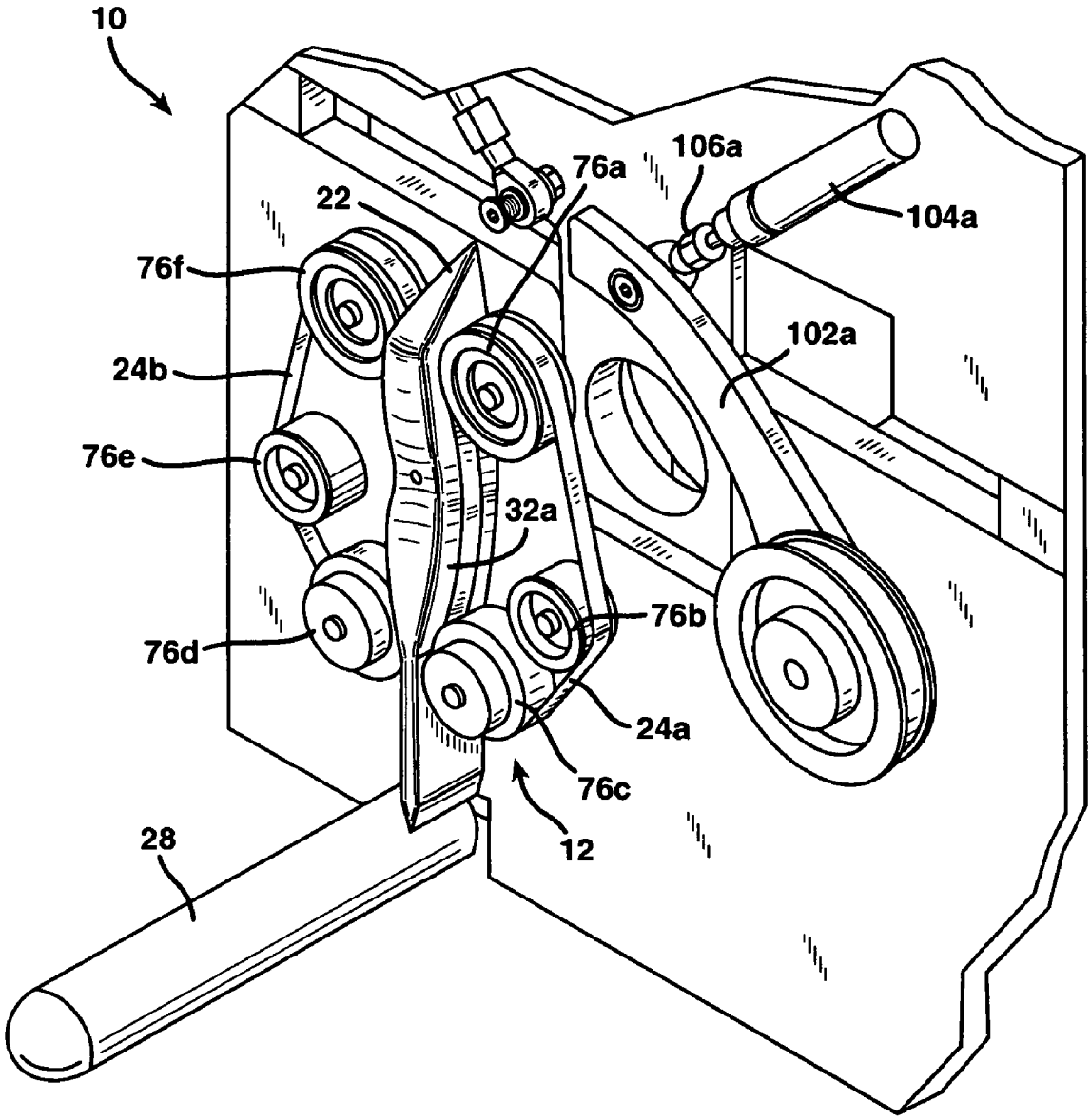
FIG. 4 is a perspective view of the apparatus as shown in FIG. 3.

Referring to FIGS. 3–4, it may be seen that the inflation assembly 12 includes an inflation device 22 and at least one pressure member 24. As illustrated, a pair of pressure members 24*a, b* are included. Inflation device 22 introduces gas into inflatable web 16. Pressure members 24*a, b* may be included to exert a compressive force against at least one, but preferably both, of respective film plies 18*a, b* such that each film ply is compressed between one of pressure members 24*a, b* and a surface of inflation device 22.

Figure 6:
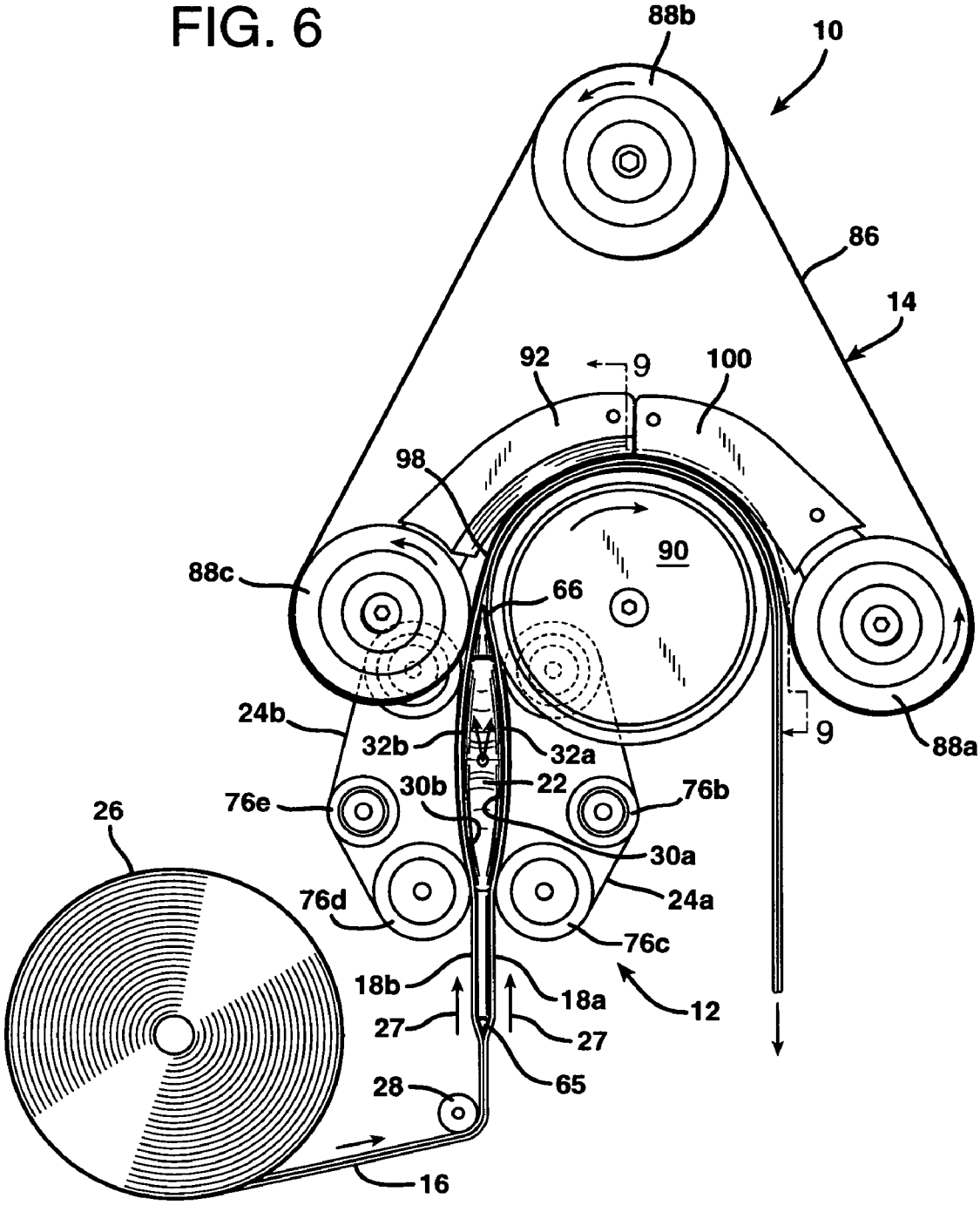
FIG. 6 is a schematic frontal view of the apparatus shown in FIG. 1, with a sectional view of an inflatable web moving through the apparatus.
Figure 7:
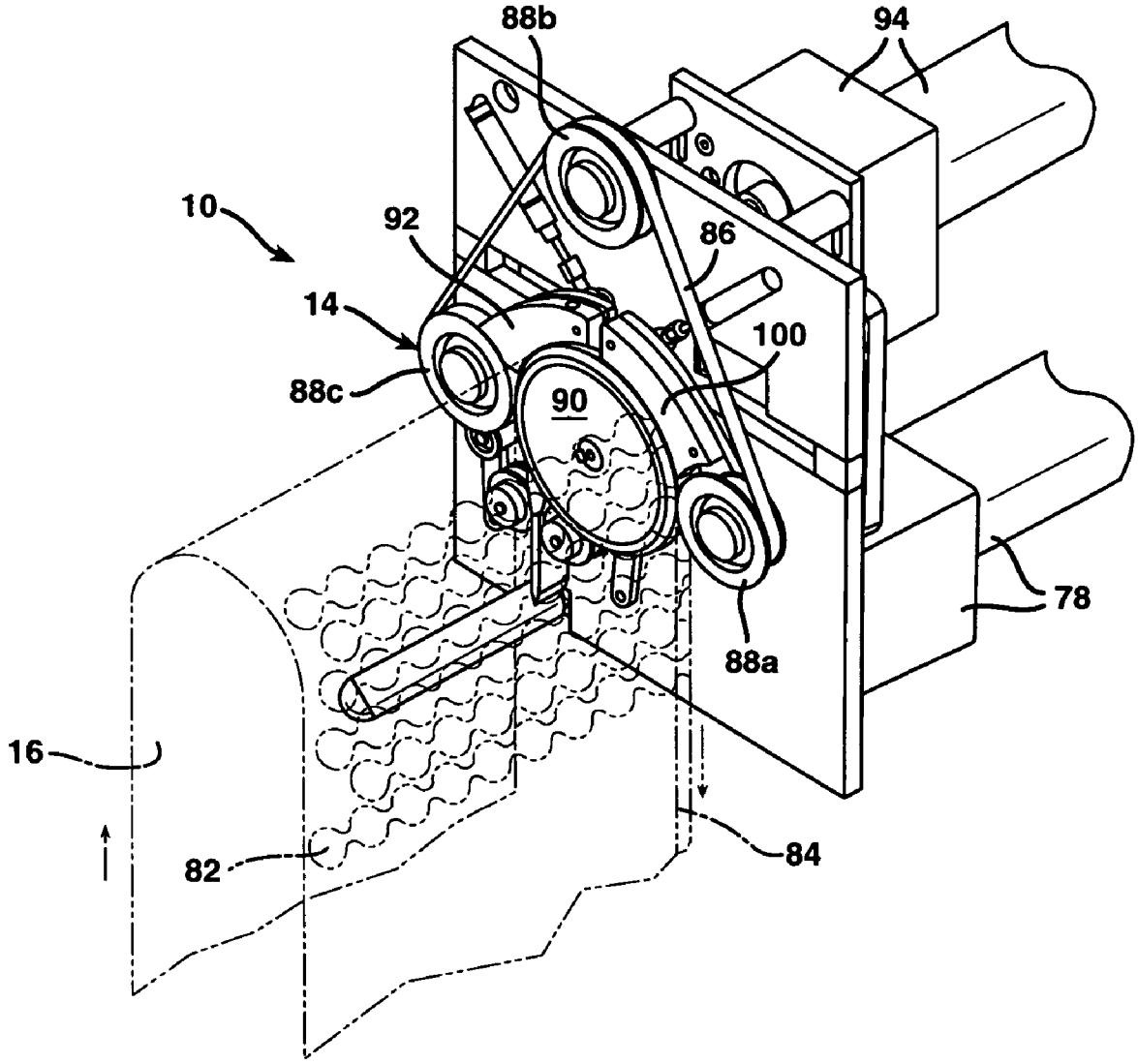
FIG. 7 is a perspective view of the apparatus and inflatable web as shown in FIG. 6.
Figure 8:
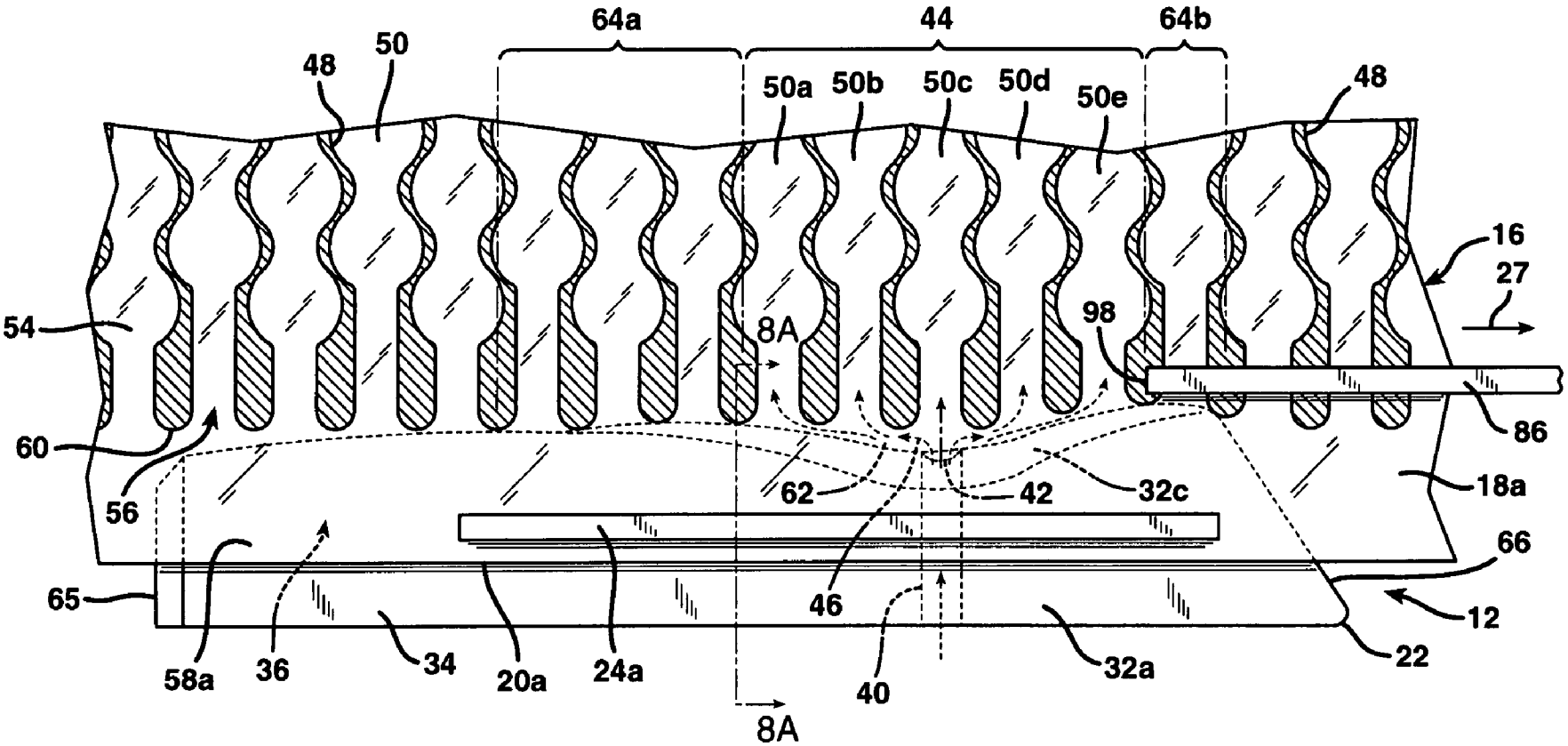
FIG. 8 is a close-up view of the inflation assembly partially shown in FIG. 7 as it introduces gas into the inflatable web.

The interaction between inflatable web 16 and inflation assembly 12 may be seen in FIGS. 6–8. FIG. 6 illustrates inflatable web 16 being withdrawn from a supply roll 26 and conveyed through apparatus 10 in a forward direction along a path of travel as shown. The forward direction in which web 16 is being conveyed is indicated by arrows 27 in FIGS. 6 and 8. The "path of travel" (or "travel path") of inflatable web 16 simply refers to the route that the web traverses while being conveyed through apparatus 10, as indicated by the shape assumed by the web due to the manipulation thereof by the components of the apparatus. Apparatus 10 may thus include one or more mechanisms that convey the inflatable web 16 along the travel path, which may include various conventional film-guide and film-drive devices, such as guide rollers and nip rollers (also known as drive rollers). For example, a guide roller 28 may be included to facilitate the guidance of web 16 into contact with inflation device 22. Moreover, as explained in further detail below, inflation assembly 12 and sealing device 14 may be part of the conveyance mechanism, and may be disposed within the travel path so that apparatus 10 is capable of producing a continuous series of inflated containers 50. As shown, the general shape of the travel path resembles an upside-down "U," but may assume any shape desired, e.g., a linear shape, a serpentine shape, etc.

For clarity, web 16 is shown in section in FIG. 6, with only those portions of film plies 18*a, b* near corresponding edges 20*a, b* being shown. A representative view of the entire width of the web is shown in perspective in FIG. 7. As illustrated, inflation device 22 makes contact with opposing inner surfaces 30*a, b* of film plies 18*a, b* as the inflatable web 16 is conveyed past the inflation device (see also FIG. 11). That is, upon contact with inflation device 22, film plies 18*a, b* separate such that surface 30*a* of film ply 18*a* makes contact with surface 32*a* of inflation device 22, and surface 30*b* of film ply 18*b* makes contact with surface 32*b* of inflation device 22 (see also FIG. 10A). In this manner, inflation device 22 can introduce gas into inflatable web 16 as the web is conveyed past the inflation device.

Figure 10A:
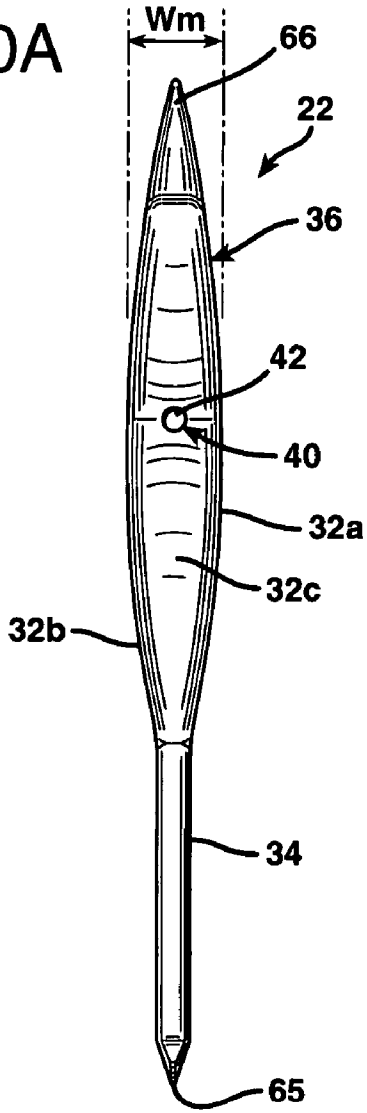
FIGS. 10–10D provide various views of the inflation device shown, e.g., in FIG. 4.
Figure 10:
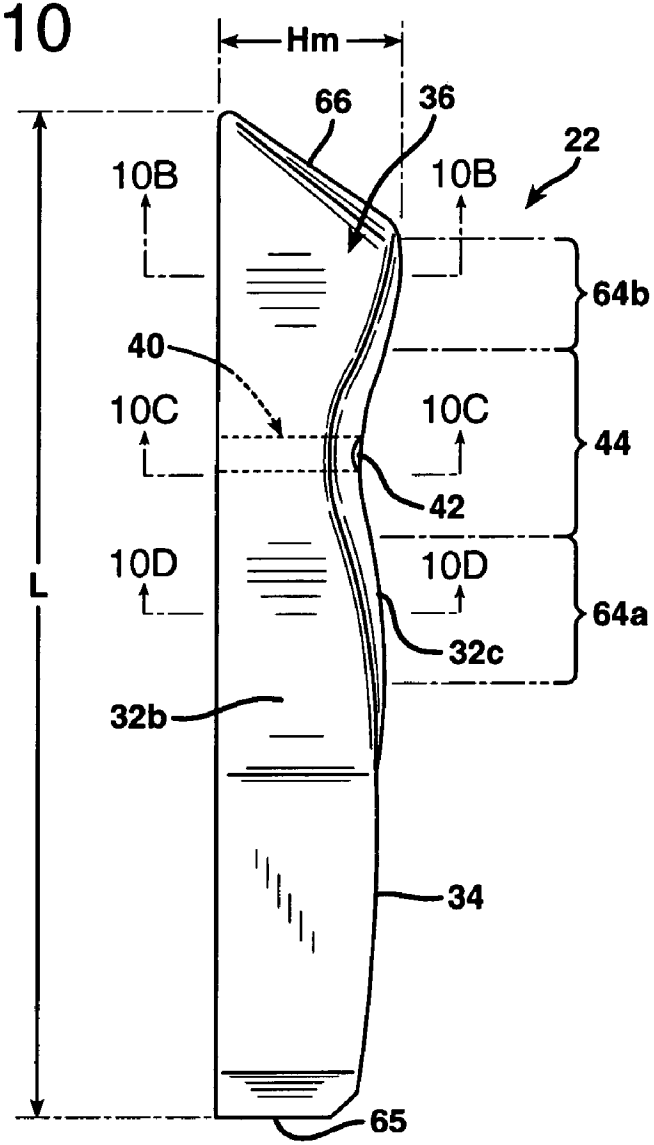
Figure 10B:
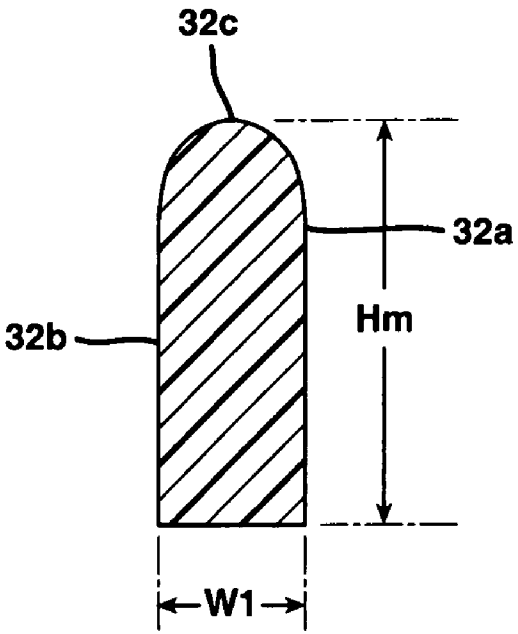
Figure 10C:
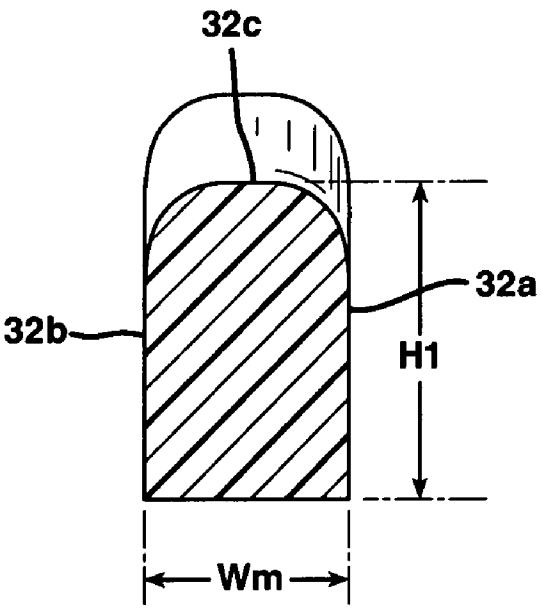
Figure 10D:
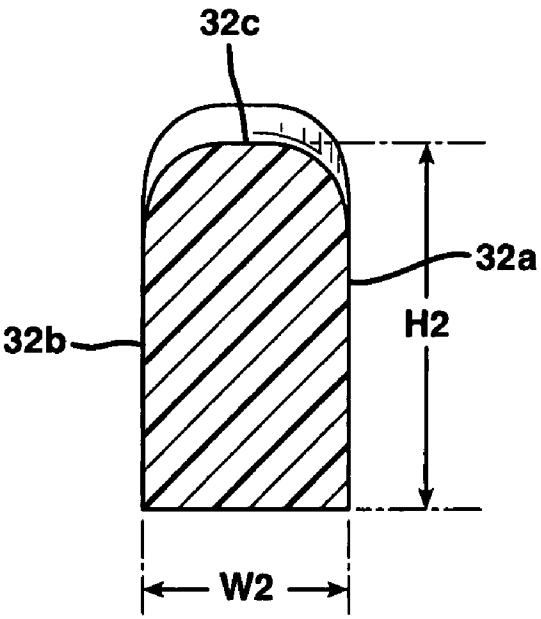

FIGS. 10–10D illustrate inflation device 22 in further detail. As shown, the inflation device includes a body 34 having a longitudinal dimension "L" and a transverse dimension, which is a dimension of body 34 measured at an angle relative to the longitudinal dimension L, e.g., a 90° angle, or any angle between 0° and 90°. Thus, the transverse dimension of body 34 can include its height, e.g., "$H_m$", or width, e.g., "$W_m$", wherein "$H_m$" represents the maximum height of the body and "$W_m$" represents the maximum width thereof.

Body 34 also includes a web-contact region 36 in which inflation device 22 makes contact with opposing surfaces of the juxtaposed film plies as gas is introduced into the inflatable web 16. Such web-contact region will generally include all or a portion of the "side" surfaces 32*a, b*, as well as the "upper" surface 32*c* of body 34. It is to be understood, however, that references to the "side" and "upper" surfaces are employed merely to facilitate the description of inflation device 22, and in no way imply, e.g., that surfaces 32*a, b* will always have upstanding orientations or that surface 32*c* will always be positioned above surfaces 32*a, b*. Rather, inflation device may be employed in any desired orientation, e.g., vertical, horizontal, upside-down, etc., to suit the particular end-use/inflation application. In any event, the web-contact region 36 will generally include those portions of surfaces 32*a–c* that are in contact with and/or enveloped by inflatable web 16 (see, e.g., FIGS. 8 and 8A).

Referring now to FIGS. 6, 8, 10, and 10A, it may be seen that body 34 is adapted to be positioned such that its longitudinal dimension L is in general alignment with at least part of the web travel path, e.g., with that part of the travel path wherein web-contact region 36 is in contact with web 16. Thus, body 34 may include a leading edge 65 and a trailing edge 66. At leading edge 65, web 16 makes initial contact with body 34; at trailing edge 66, web 16 makes final contact with the body. Accordingly, when web 16 is conveyed in the forward direction 27 as shown, any given part of the web first encounters leading edge 65, then moves forward along the longitudinal dimension L of body 34 before finally breaking contact with body 34 at trailing edge 66.

Figure 8A:
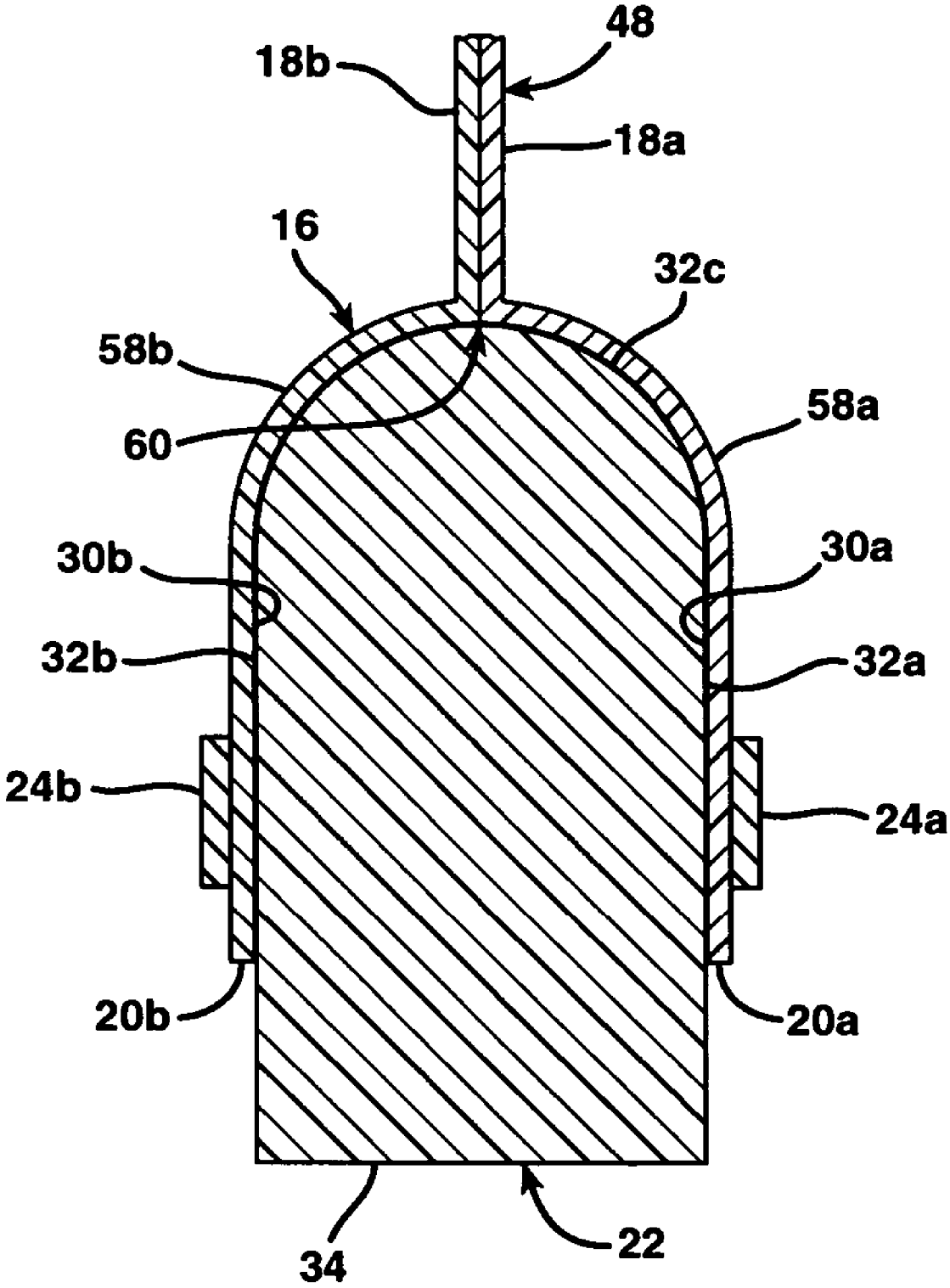
FIG. 8A is a sectional view of the inflation assembly and inflatable web taken along line 8A—8A in FIG. 8.

Referring now to FIGS. 8 and 8A, body 34 will be further described as including at least one increase in peripheral transverse surface distance along the longitudinal dimension L of the body in the forward direction 27 of web travel, i.e., from leading edge 65 to trailing edge 66. The peripheral transverse surface distance of body 34 is measured in a direction that is substantially transverse, e.g., at a substantially perpendicular angle, to the longitudinal dimension L of the body (see FIG. 10), and extends from one of the opposing film edges to the other, i.e., from film edge 20*a* to film edge 20*b*, within the web-contact region 36 of body 34. The peripheral transverse surface distance is thus a measurement of the lineal surface width (i.e., periphery) of the web-contact region 36 of body 34 at any point along the longitudinal dimension L. In FIG. 8A, for example, a cross-sectional view of the peripheral transverse surface distance of body 34 is shown at the point indicated in FIG. 8, at an angle that is perpendicular to the longitudinal dimension L of body 34. The peripheral transverse surface distance of body 34 in FIG. 8A may thus be determined, e.g., beginning at edge 20*a* of inflatable web 16, by measuring the lineal distance from film edge 20*a* to the top of side surface 32*a* (where side surface 32*a* meets the upper surface 32*c*), adding the lineal distance along the arc-shaped upper surface 32*c*, and then adding the lineal distance from the top of side surface 32*b* (where side surface 32*b* meets the other side of upper surface 32*c*) to film edge 20*b*.

As depicted in FIGS. 8 and 8A, film edges 20*a, b* do not extend all the way down the respective side surfaces 32*a, b*, such that the web-contact region 36 of body 34 does not include the entirety of the outer surface of inflation device 22. That is, while the web-contact region 36 of body 34 includes all of upper surface 32*c*, only a portion of side surfaces 32*a, b* are included in the web-contact region. However, this need not be the case. The web-contact region may, for example, include only upper surface 32*c*. Alternatively, the web-contact region may include all of side surfaces 32*a, b*, as well as the upper surface 32*c*. The extent, i.e., size, of the web-contact region will vary depending upon the particular end-use application, and will depend upon such factors as the configuration of the inflation apparatus and web travel path, the specific shape of the inflation device, the seal pattern used in the inflatable web, the applied inflation pressure, etc.

Figure 16:
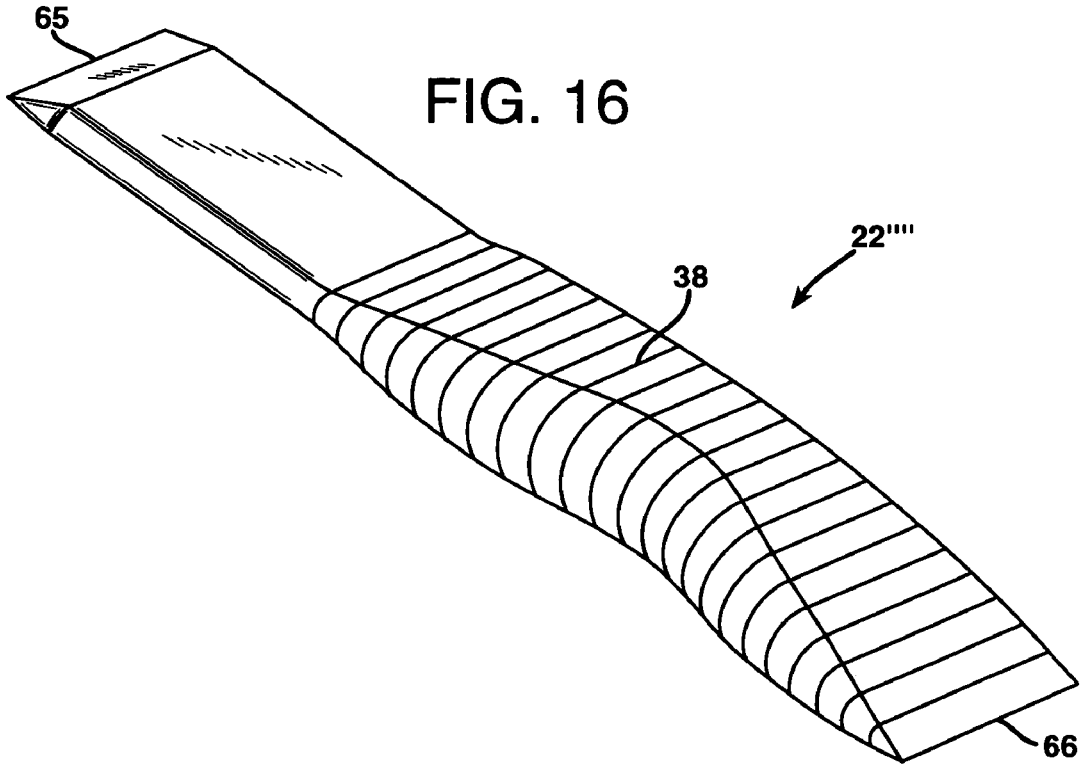
FIG. 16 is a perspective, simplified view of the inflation device shown in FIGS. 10–10D.

Peripheral transverse surface distances for a variety of inflation devices in accordance with the present invention were measured, recorded, and graphed. Such inflation devices 22', 22", 22''', and 22'''' are shown in FIGS. 13–16, respectively. Like device 22, devices 22'–22'''' all have at least one increase in peripheral transverse surface distance along the longitudinal dimension L of their respective bodies in the forward direction 27 of web travel, i.e., going from leading edge 65 to trailing edge 66. Device 22'''', as shown in FIG. 16, has essentially the same profile as device 22, except that device 22 contains refinements such as a sloped edge 66 and passage 40 (see FIG. 10).

Figure 17A:
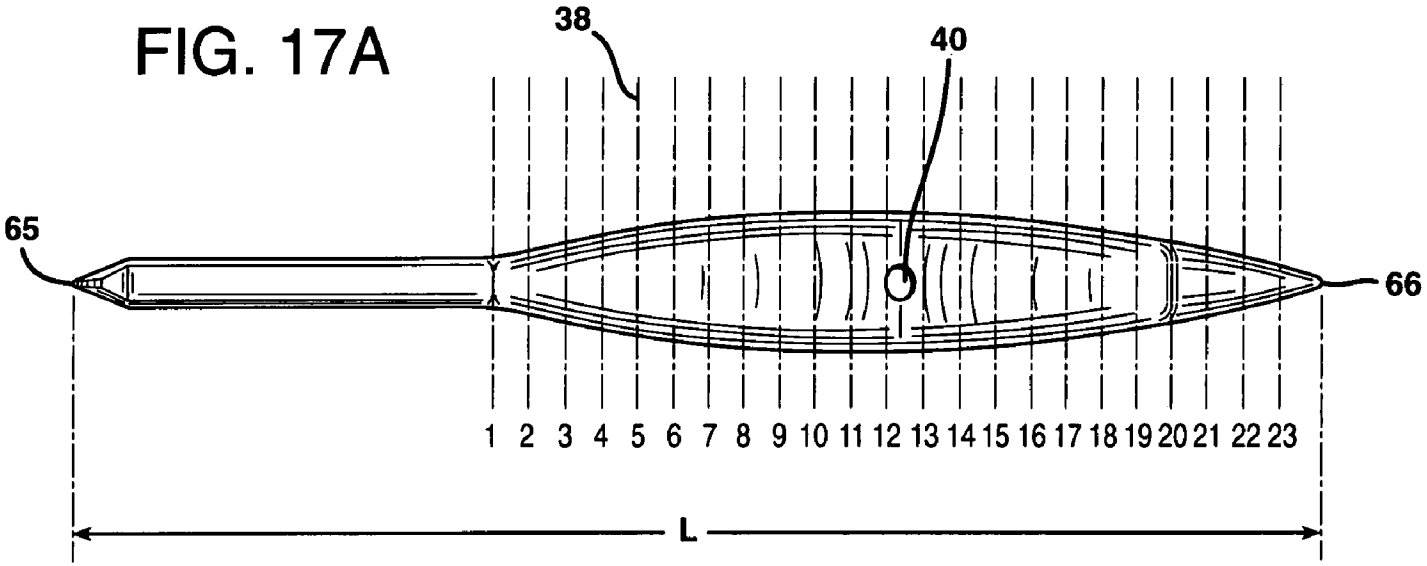
FIG. 17 is a plan view and cross-sectional view of a representative inflation device, showing the location of measurement lines used to determine the peripheral transverse surface distances of the devices shown in FIGS. 13–16.

FIGS. 13–16 show the measurement lines, generally designated at 38, along which the peripheral transverse surface distances were determined. As shown, such measurement lines were taken at spaced intervals along the length dimension L of each inflation device. Such lines are graphically illustrated in FIGS. 17A and 17B, which provides a plan view and cross-sectional view of a representative inflation device. FIG. 17A indicates that a total of 23 such measurement lines were taken for each of the inflation devices 22'–22'''' in FIGS. 13–16, and also shows the location of each measurement line. As shown, the measurements began "downstream" of leading edge 65, and proceeded sequentially along the length dimension L in the forward direction 27 towards the trailing edge 66.

Figure 17B:
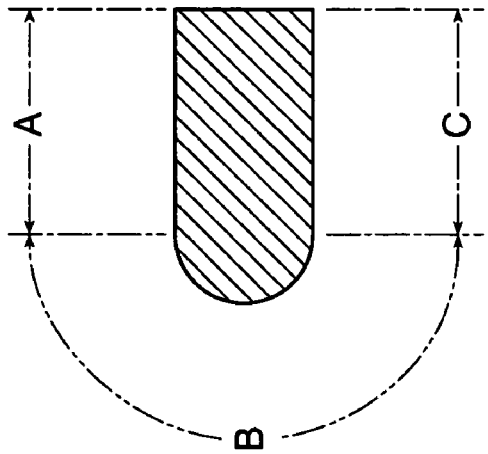

FIG. 17B, a cross-sectional view of the inflation device, indicates that the measured peripheral transverse surface distance is the total of distances "A" and "C," which are the distances of opposing side surfaces 32*a, b*, and distance "B," which is the distance of the upper surface 32*c*. The measured peripheral transverse surface distances are thus based on a presumed web-contact region 36 that encompasses all of side surfaces 32*a, b*, as well as the upper surface 32*c*. As explained above, however, this will not always be the case in actual use. Nevertheless, employing the same web-contact region for all measurements in FIGS. 13–17 is beneficial for present purposes, which is to illustrate how inflation devices in accordance with the present invention have at least one increase in peripheral transverse surface distance along the longitudinal dimension L in the forward direction of web travel.

The results are set forth below in Table 1.

TABLE 1

| Measurement Line | Peripheral Transverse Surface Distance: A + B + C (Inches) FIG. 13 | FIG. 14 | FIG. 15 | FIG. 16 |
|---|---|---|---|---|
| 1 | 2.223 | 2.22 | 2.22 | 2.22 |
| 2 | 2.28 | 2.45 | 2.336 | 2.303 |
| 3 | 2.334 | 2.726 | 2.471 | 2.399 |
| 4 | 2.373 | 2.937 | 2.572 | 2.471 |
| 5 | 2.399 | 3.08 | 2.638 | 2.519 |
| 6 | 2.41 | 3.152 | 2.67 | 2.542 |
| 7 | 2.407 | 3.149 | 2.666 | 2.541 |
| 8 | 2.389 | 3.067 | 2.627 | 2.516 |
| 9 | 2.358 | 2.871 | 2.541 | 2.459 |
| 10 | 2.312 | 2.512 | 2.391 | 2.359 |
| 11 | 2.252 | 2.296 | 2.296 | 2.296 |
| 12 | 2.215 | 2.29 | 2.294 | 2.294 |
| 13 | 2.281 | 2.299 | 2.296 | 2.296 |
| 14 | 2.36 | 2.433 | 2.352 | 2.338 |
| 15 | 2.425 | 2.685 | 2.454 | 2.415 |
| 16 | 2.476 | 2.977 | 2.572 | 2.505 |
| 17 | 2.513 | 3.22 | 2.674 | 2.584 |
| 18 | 2.536 | 3.328 | 2.726 | 2.626 |
| 19 | 2.545 | 3.332 | 2.738 | 2.638 |
| 20 | 2.539 | 3.274 | 2.725 | 2.631 |
| 21 | 2.518 | 3.158 | 2.688 | 2.607 |
| 22 | 2.483 | 2.984 | 2.627 | 2.564 |
| 23 | 2.433 | 2.754 | 2.541 | 2.503 |

Figure 18:
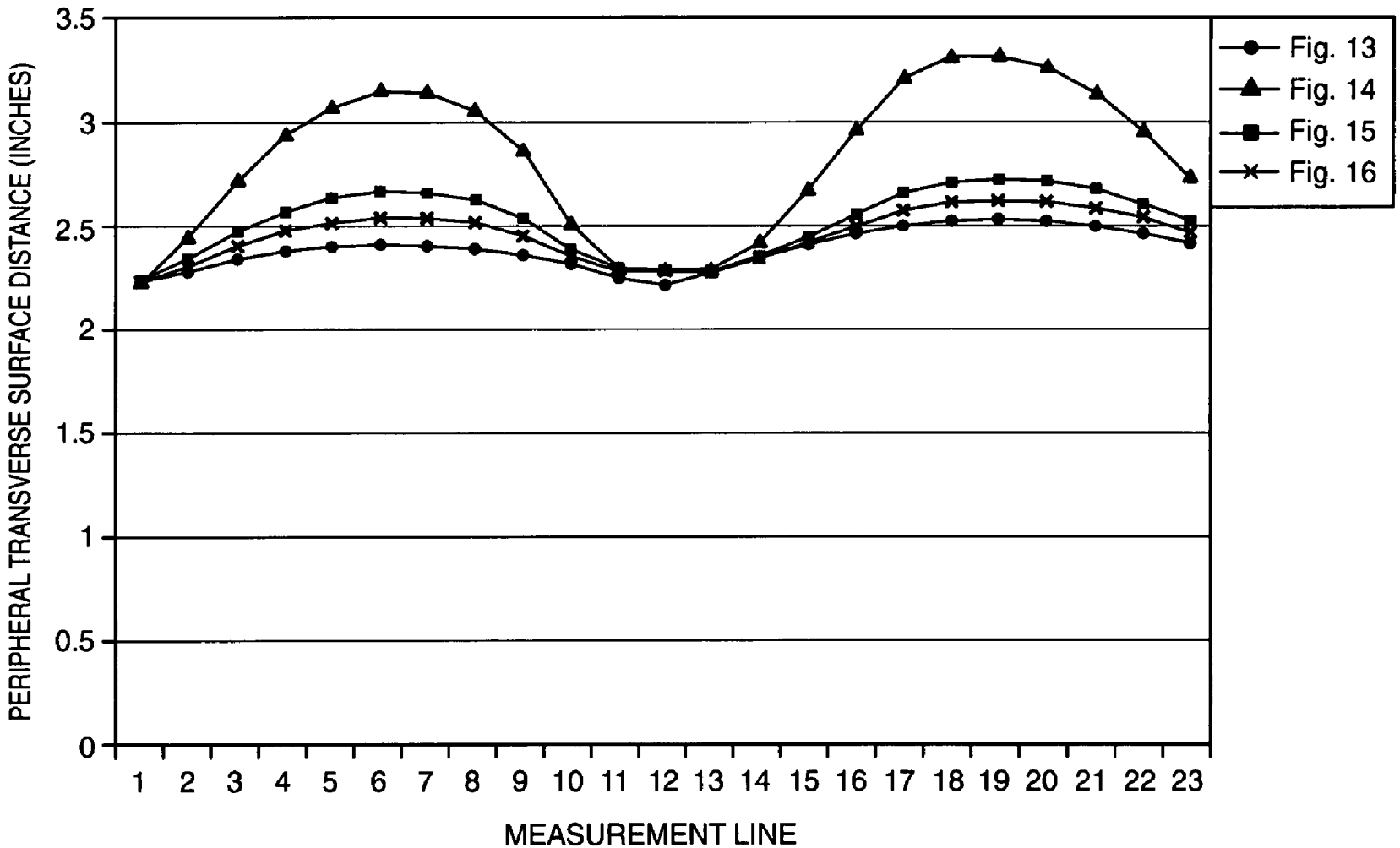
FIG. 18 is graph, showing the peripheral transverse surface distances of the devices shown in FIGS. 13–16.

The results from Table 1 are also set forth in graphical form in FIG. 18. As indicated in Table 1 and shown in FIG. 18, each of the inflation devices 22'–22'''' have at least one increase in peripheral transverse surface distance along the longitudinal dimension L of their bodies 34 in the forward direction of web travel, i.e., from leading edge 65 to trailing edge 66. Each of inflation devices 22'–22'''' exhibit two primary regions of increase in peripheral transverse surface distance. The first such region occurs between measurement lines 1 and 6; the second increase occurs between measurement lines 12 and 19. In some embodiments of the invention, only one increase in peripheral transverse surface distance may be necessary; in other embodiments, more than two increases may be desirable.

As shown, the peripheral transverse surface distance may increase gradually and continuously, i.e., as an analog function rather than as a step function, which may facilitate the movement of an inflatable web past the inflation device. As will be explained below, an inflation device having at least one increase in peripheral transverse surface distance along the longitudinal dimension L of the body in the forward direction of web travel has been found to increase the efficiency with which the device introduces gas into an inflatable web.

Referring back to FIGS. 10 and 10A, inflation device 22 further includes a passage 40 within body 34 through which gas may flow. Passage 40 has a termination point 42 within web-contact region 36 to form an inflation zone 44 therein.

As shown, termination point 42 of passage 40 may be positioned in upper surface 32*c*. Inflation zone 44 is a part of the web-contact region 36 of body 34 in the vicinity of termination point 42. The space adjacent to inflation zone 44 is a location where gas emerges from inflation device 22 to introduce gas into an inflatable web. This may perhaps be best seen in FIG. 8, wherein flowing gas out of termination point 42, represented by the arrows 46, is introduced into inflatable web 16 adjacent to inflation zone 44. Termination point 42 thus serves as a gas outlet port for inflation device 22. Inflation assembly 12 also includes a conduit and gas source (not shown) to supply gas, e.g., air, nitrogen, carbon dioxide, etc., to inflation device 22. Such conduit may be inserted into the opening of passage 40 at the end opposite to outlet port 42.

An advantageous feature of the invention is that the peripheral transverse surface distance of body 34 at inflation zone 44 may be less than that of other portions of inflation device 22. This feature may be particularly beneficial when used to inflate webs of the type that contain a plurality of seals that have a substantially transverse orientation, i.e., at an angle to the longitudinal dimension L of the inflation device, to define a series of containers.

For example, with reference to FIG. 11, inflatable web 16 may contain a pattern of transverse seals 48 that define a series of inflatable containers 50. Each of the inflatable containers 50 have a closed distal end 52 and an open proximal end 54, which communicates with inflation port 56. The inflation ports 56 provide openings into each container 50, thereby allowing gas to be introduced into, to thereby inflate, the containers. Inflatable web 16 further includes a pair of longitudinal flanges 58*a, b*, which are formed by a portion of each of film plies 18*a, b* that extend beyond inflation ports 56 and the proximal ends 60 of seals 48; flanges 58*a, b*, therefore, are not sealed together. In other words, seals 48 terminate at proximal ends 60, which are spaced a predetermined distance "D" from edges 20*a, b* of film plies 18*a, b*. As a corollary, flanges 58*a, b* extend a predetermined distance "D" beyond the proximal ends 60 of seals 48. Flanges 58*a, b* may each have the same width D as shown or, if desired, may each have a different width.

As shown in FIGS. 8 and 8A, flanges 58*a, b* advantageously form an 'open skirt,' which facilitates inflation of containers 50 by allowing inflation device 22 to pass between the flanges as the inflatable web 16 moves past the inflation device during the inflation process. Inflation device 22 thus "rides" in the groove defined by the open skirt provided by flanges 58*a, b*. This, in turn, allows the termination point, i.e., gas outlet port, 42 of passage 40 to be positioned in close proximity to inflation ports 56 of containers 50 as the ports move past the outlet port 42.

FIG. 8 also shows how inflation device 22 may facilitate the inflation of web 16 when the peripheral transverse surface distance of body 34 at inflation zone 44 is less than that of other portions of the inflation device body. In particular, the smaller peripheral transverse surface distance in inflation zone 44 provides a small gap 62 between the outlet port 42/upper surface 32*c* of inflation device 22 and the proximal ends 60 of seals 48. This allows gas 46 to more easily flow from outlet port/termination point 42 and into the inflation ports 56 of containers 50. Moreover, depending on the length of the inflation zone 44, it may be possible to inflate multiple chambers 50 in simultaneous fashion. As shown, inflation zone 44 may be of sufficient length that five chambers, designated 50*a*14 50*e*, are being inflated at the same time. In addition, the gap 62, which may result from inflation zone 44 having a peripheral transverse surface distance that is less than that of other portions of inflation device 22, was found to result in less noise being generated during inflation than if no gap were present.

In many instances, however, merely providing a gap 62 between the outlet port 42/upper surface 32*c* of inflation device 22 and the proximal ends 60 of seals 48 could be disadvantageous because gas 46 may dissipate longitudinally within such gap, i.e., between upper surface 32*c* and proximal ends 60, without generating sufficient pressure to flow into the inflation ports 56. In other instances, even if sufficient gas pressure is produced in the gap to generate gas-flow into the inflation ports, the efficiency of the inflation operation is nevertheless poor because of gas leakage, i.e., because not all of the gas flowing out of outlet port 42 is used for inflation of the chambers 50 adjacent inflation zone 44 for immediate sealing by sealing device 14. As a result, the speed of the operation has to be reduced and/or excess gas flow has to be provided. The former results in slower production while the latter results in higher costs and noise levels.

Accordingly, another feature of the present invention is that inflation device 22 may, if desired, include at least one, but preferably two, isolation zones 64*a, b*, each having a peripheral transverse surface distance that is greater than that of inflation zone 44. Each of isolation zones 64*a, b* result from the two regions of increasing peripheral transverse surface distance along the longitudinal dimension L of body 34 in the forward direction of web travel, as discussed herein above in relation to Table 1 and FIG. 18. More preferably, inflation zone 44 may be disposed between isolation zones 64*a, b* as shown. Thus, inflation zone 44 may be viewed as being formed by the 'valley' between the two 'mountains' formed by isolation zones 64*a, b*.

Because isolation zones 64*a, b* have a peripheral transverse surface distance that is greater than that of inflation zone 44, inflatable web 16 can be conveyed past inflation device 22 in such a manner that flanges 58*a, b* conform relatively tightly against the outer surfaces 32*a–c* of inflation device 22 in the isolation zones 64*a, b*, with proximal ends 60 of seals 48 in close contact with upper surface 32*c*. In contrast, proximal ends 60 are not in contact with surface 32*c* of inflation device 22 in the inflation zone 44, thereby resulting in gap 62. Such relatively tight conformation between flanges 58*a, b*, proximal ends 60 of seals 48, and inflation device 22 in isolation zones 64*a, b* produces a beneficial isolation of the containers that are adjacent to the inflation zone 44, e.g., containers 50*a–e* as shown, so that gas 46 in gap 62 is contained between the isolation zones, and is thereby forced to flow into such containers. FIG. 8A, which is a cross-sectional view at the 'downstream' end of isolation zone 64*a*, illustrates perhaps most clearly the relatively tight conformation between flanges 58*a, b*, proximal ends 60 of seals 48, and inflation device 22 in the isolation zones.

The differences in peripheral transverse surface distances between isolation zones 64*a, b* and inflation zone 44 is illustrated graphically in FIGS. 17 and 18 for each of the inflation devices shown in FIGS. 13–16. In each of the inflations devices 22'–22'''', a gas passage such as 40 in device 22 may be located approximately between lines 10 and 15 of the measurement lines 38 (see FIGS. 17A and 18). In this instance, the inflation zone 44 for each of the devices 22'–22'''' would therefore be located approximately between lines 8 and 17, with isolation zone 64*a* being located approximately between lines 4 and 8 and isolation zone 64*b* being located approximately between lines 17 and 22. As shown, the peripheral transverse surface distance may be greater at the 'downstream' isolation zone 64*b* than at the 'upstream' isolation zone 64*a*, with both having a greater peripheral transverse surface distance than inflation zone 44.

If desired, the pressure of the gas 46 in gap 62, passage 40, and/or in the conduit (not shown) that delivers gas to inflation device 22 may be monitored, e.g., via a pressure sensor and/or pressure transducer. This information may be used to determine, e.g., when the chambers 50 have reached a desired level of inflation. Such information may be conveyed to a controller, e.g., a PLC-type controller, to facilitate control of the operation of apparatus 10. Such a controller may control, e.g., the rate at which the inflatable web 16 is conveyed through the apparatus.

Web 16 is preferably conveyed in a substantially continuous manner. Thus, as inflated containers move out of inflation zone 44 and enter isolation zone 64*b*, un-inflated containers will move from isolation zone 64*a* to inflation zone 44. However, because isolation zones 64*a, b* have a peripheral transverse surface distance that is greater than that of inflation zone 44, gas 46 flowing from passage 40 will continue to be trapped in gap 62 between the isolation zones.

Referring again to FIGS. 10–10D, it may be seen that inflation device 22 may have a contoured surface, e.g., at 32*a, b*, and/or c of body 34. This may be advantageous from the standpoint of providing a relatively smooth transition along the longitudinal dimension L of body 34 as the peripheral transverse surface distance changes. That is, a smooth transition in this manner may facilitate the conveyance of inflatable web 16 past inflation device 22. Accordingly, at least a portion of surfaces 32*a, b*, and/or c may have a convex shape, e.g., at surfaces 32*a, b* (FIG. 10A), and/or a concave shape, e.g., at surface 32*c* (FIG. 10). As shown in FIGS. 10B–10D, inflation device 22 may also have at least one change in transverse width or height along the longitudinal dimension L of body 34. As shown, the transverse width W varies from a maximum width, designated Wm in FIG. 10C, to smaller widths, designated W1 and W2 in FIGS. 10B and D, respectively. Similarly, the transverse height H varies from a maximum height, designated Hm in FIG. 10B, to smaller heights, designated H1 and H2 in FIGS. 10C and D, respectively.

Figure 13:
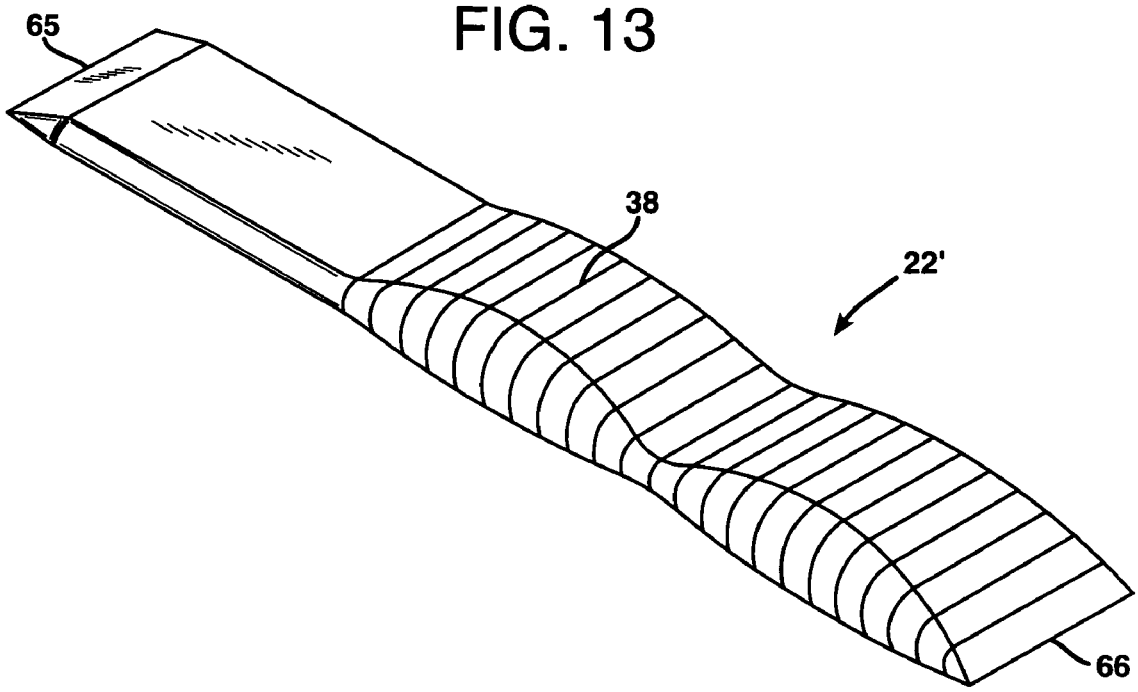
FIG. 13 is a perspective view of an alternative inflation device.
Figure 14:
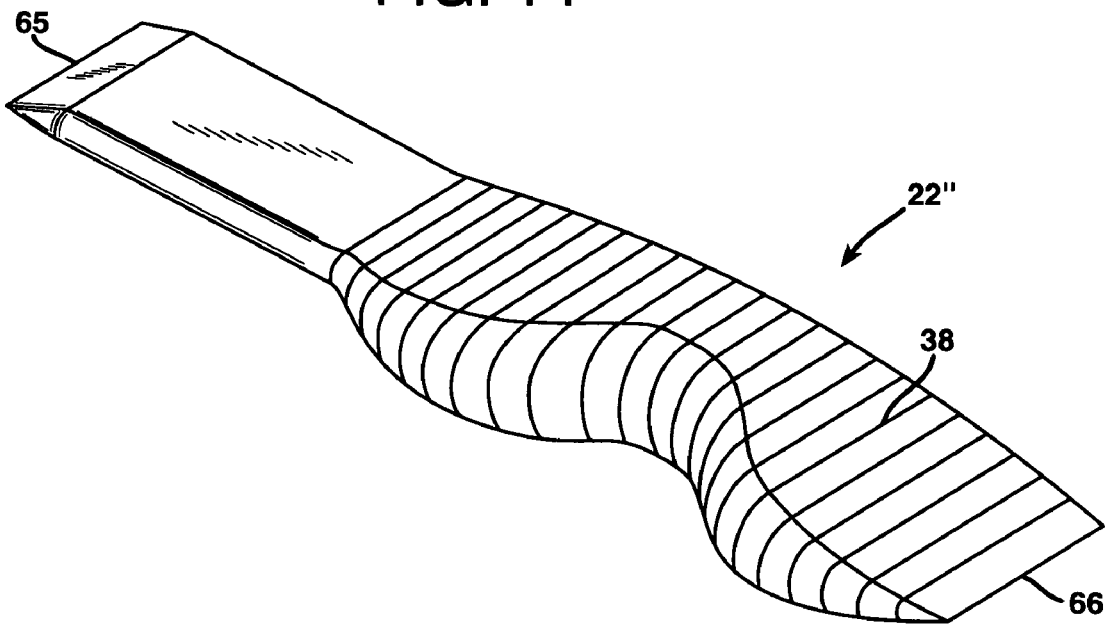
FIG. 14 is a perspective view of a further alternative inflation device.
Figure 15:
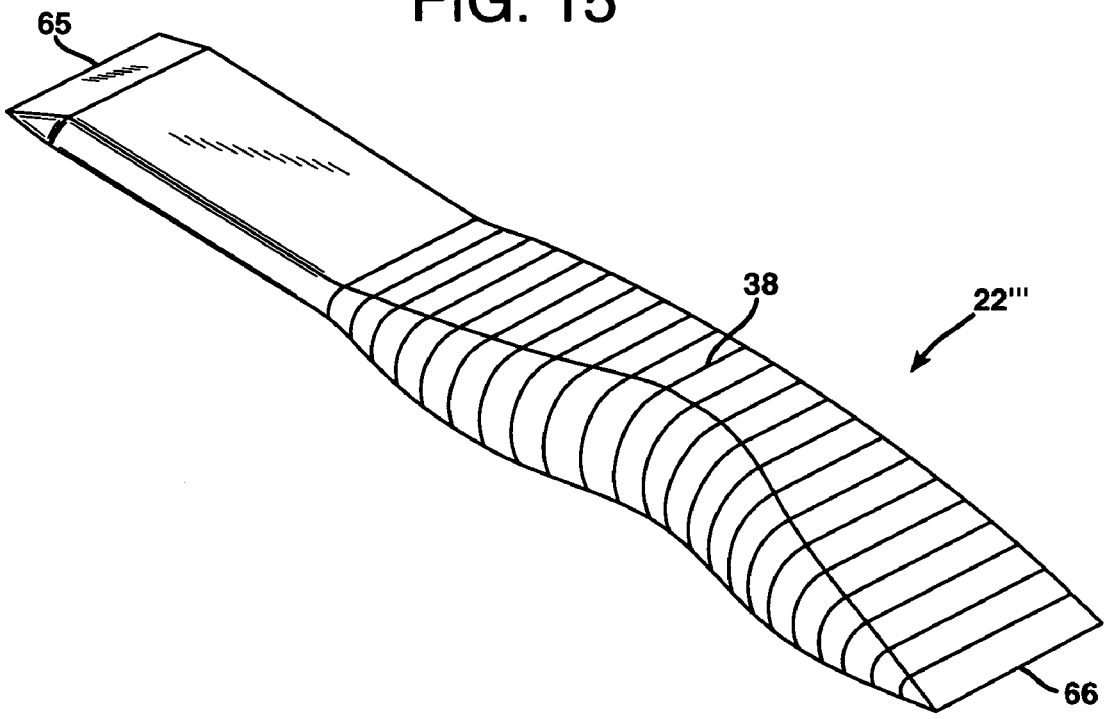
FIG. 15 is a perspective view of another alternative inflation device.
Figure 20:
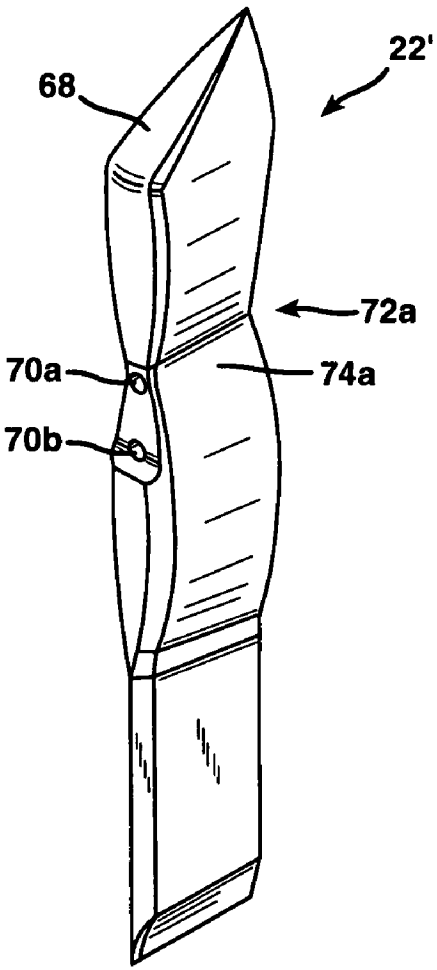
FIGS. 19–20 are plan and perspective views, respectively, showing further details of the inflation device shown FIG. 13.
Figure 19:
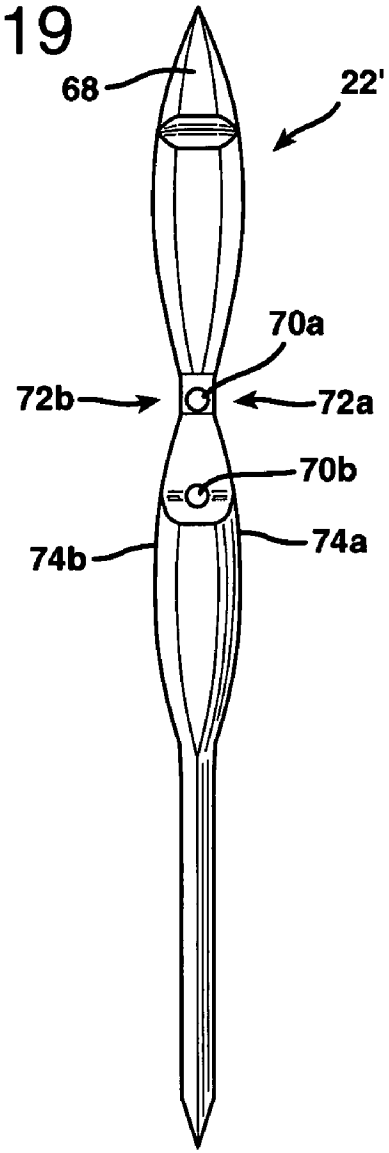

FIGS. 19 and 20 illustrate further details of inflation device 22' as shown in FIG. 13, and include refinements such as a sloped edge 68 and dual gas passages 70*a, b*. Device 22' also includes concave regions 72*a, b* on side surfaces 74*a, b*.

Inflation devices in accordance with the present may be constructed from any material that allows an inflatable web to pass over the device with minimal frictional resistance to the movement of the web, i.e., a material having a low coefficient of friction ("COF"). Many suitable materials exist; examples include various metals such as aluminum; metals with low-COF coatings (e.g., anodized aluminum or nickel impregnated with low-COF polymers such as PTFE or other fluorocarbons); polymeric materials such as ultra-high molecular weight polyethylene, acetal, or PTFE-filled acetal resins; and mixtures or combinations of the foregoing.

Inflatable web 16 may, in general, comprise any flexible material that can be manipulated by apparatus 10 to enclose a gas as herein described, including various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other polymeric materials may also be used such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known extrusion process by melting the component polymer(s) and extruding, coextruding, or extrusion-coating them through one or more flat or annular dies.

It is to be understood that the present invention is not limited to any specific type of inflatable web, and that web 16 is described and shown for the purpose of illustration only. Further details regarding inflatable web 16 may be found in U.S. Ser. No. 10/057,067, filed Jan. 25, 2002 and published under Publication No. 20020166788, and in U.S. Pat. No. 6,800,162, the disclosures of which are hereby incorporated herein by reference. Another example of an inflatable web that may be used in connection with the present invention is described in U.S. Pat. No. 6,651,406, the disclosure of which is hereby incorporated herein by reference.

The seals that make up the inflatable containers, such as seals 48, may be preformed, i.e., formed prior to loading the inflatable web on apparatus 10, or formed 'in-line' by apparatus 10, e.g., by including additional seal-forming machinery to the apparatus as disclosed, for example, in U.S. Ser. No. 10/979,583, filed Nov. 2, 2004, the disclosure of which is hereby incorporated herein by reference.

As noted above, inflation assembly 12 may include pressure members 24*a, b* to exert a compressive force against at least one, but preferably both, of respective film plies 18*a, b* such that the film plies are compressed between one of pressure members 24*a, b* and a respective surface 32*a, b* of inflation device 22 (see FIGS. 3–4, 6, and 8). Pressure members 24*a, b* may comprise a pair of counter-rotating belts as shown, which may be positioned via rollers 76*a–f* such that the belts rotate against, i.e., in contact with, surfaces 32*a, b* of inflation device 22. Thus, when an inflatable web, such as web 16, is conveyed through the inflation assembly 12, the pressure members 24*a, b* contact flanges 58*a, b* of respective film plies 18*a, b*, and thereby compress the flanges between the pressure members and the surfaces 32*a, b* of inflation device 22 (see FIG. 8A).

Figure 2:
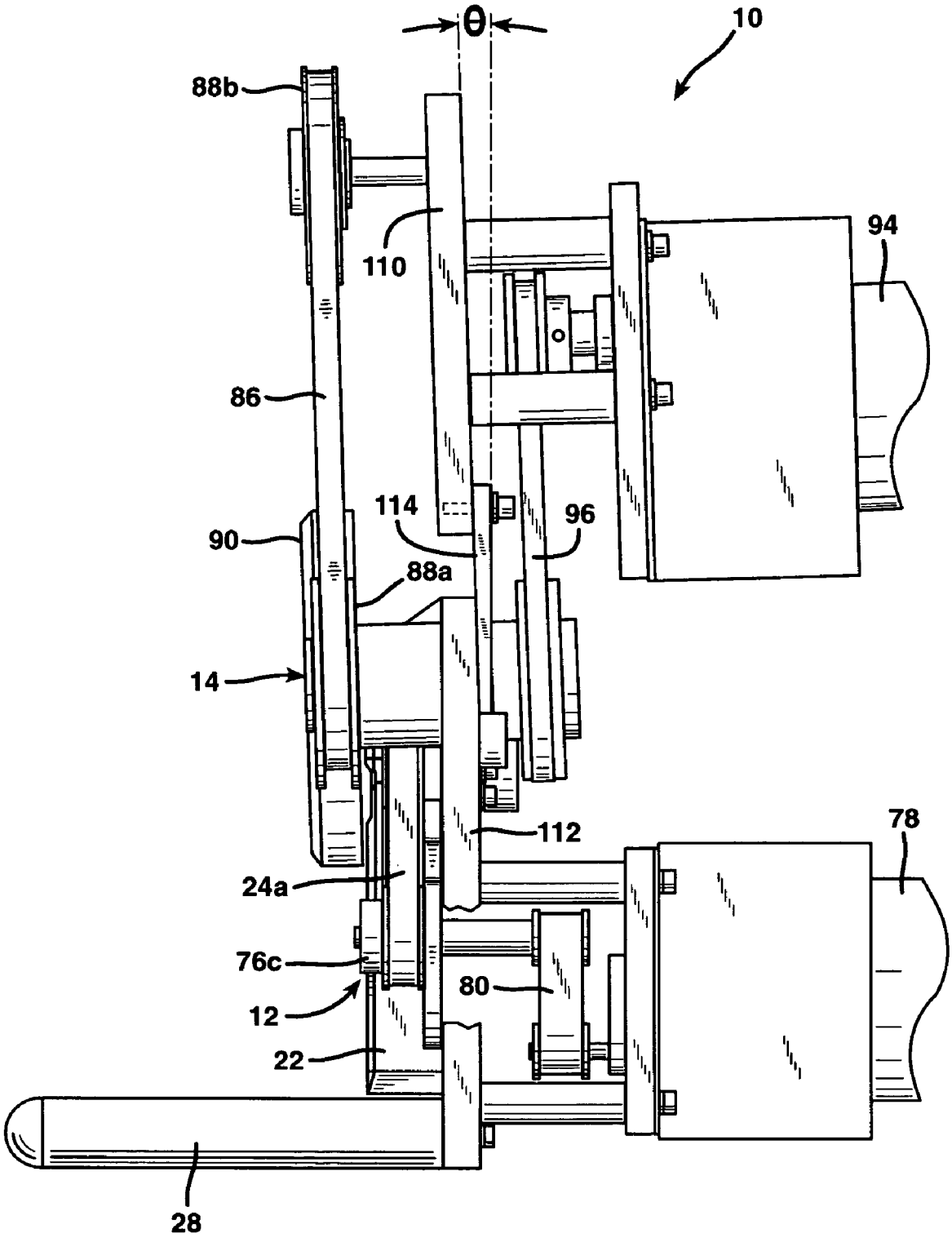
FIG. 2 is a side elevational view of the apparatus shown in FIG. 1.

Motor 78 may be included to drive the rotation of some or all of the rollers 76*a–f* (see FIG. 1). As shown in FIG. 2, for example, motor 78 may drive the rotation of roller 76*c* via linkage (e.g., belt) 80, and also drive the rotation of roller 76*d* via similar linkage (not shown). The compression of film plies 18*a, b* between the pressure members 24*a, b* and the inflation device 22, as exerted by the pressure members, may be such that the pressure members effect relative motion between the inflatable web and the inflation device. For example, the pressure members 24*a, b* may be part of the conveyance mechanism that moves the inflatable web 16 along the path of travel and through apparatus 10 (FIG. 6).

Moreover, pressure members 24*a, b* and isolation zones 64*a, b* may cooperate to direct gas stream 46 into the openings or inflation ports 56 of containers 50 that are adjacent to inflation zone 44, i.e., containers 50*a–e* as depicted in FIG. 8. As explained above, isolation zones 64*a, b* provide a degree of isolation of the containers 50*a–e* that are adjacent to the inflation zone 44 so that gas 46 in gap 62 is contained between the isolation zones. Similarly, by compressing flanges 58*a, b* of respective film plies 18*a, b* against surfaces 32*a, b* of inflation device 22, pressure members 24*a, b* may provide additional isolation of containers 50*a–e* by substantially preventing gas from leaking between flanges 58*a, b* and surfaces 32*a, b* of inflation device 22 in those areas where pressure members are in contact with the flanges. To this end, pressure members 24*a, b* may advantageously be positioned adjacent the isolation zones 64*a, b* and inflation zone 44 of inflation device 22, as shown perhaps most clearly in FIG. 8.

Figure 21:
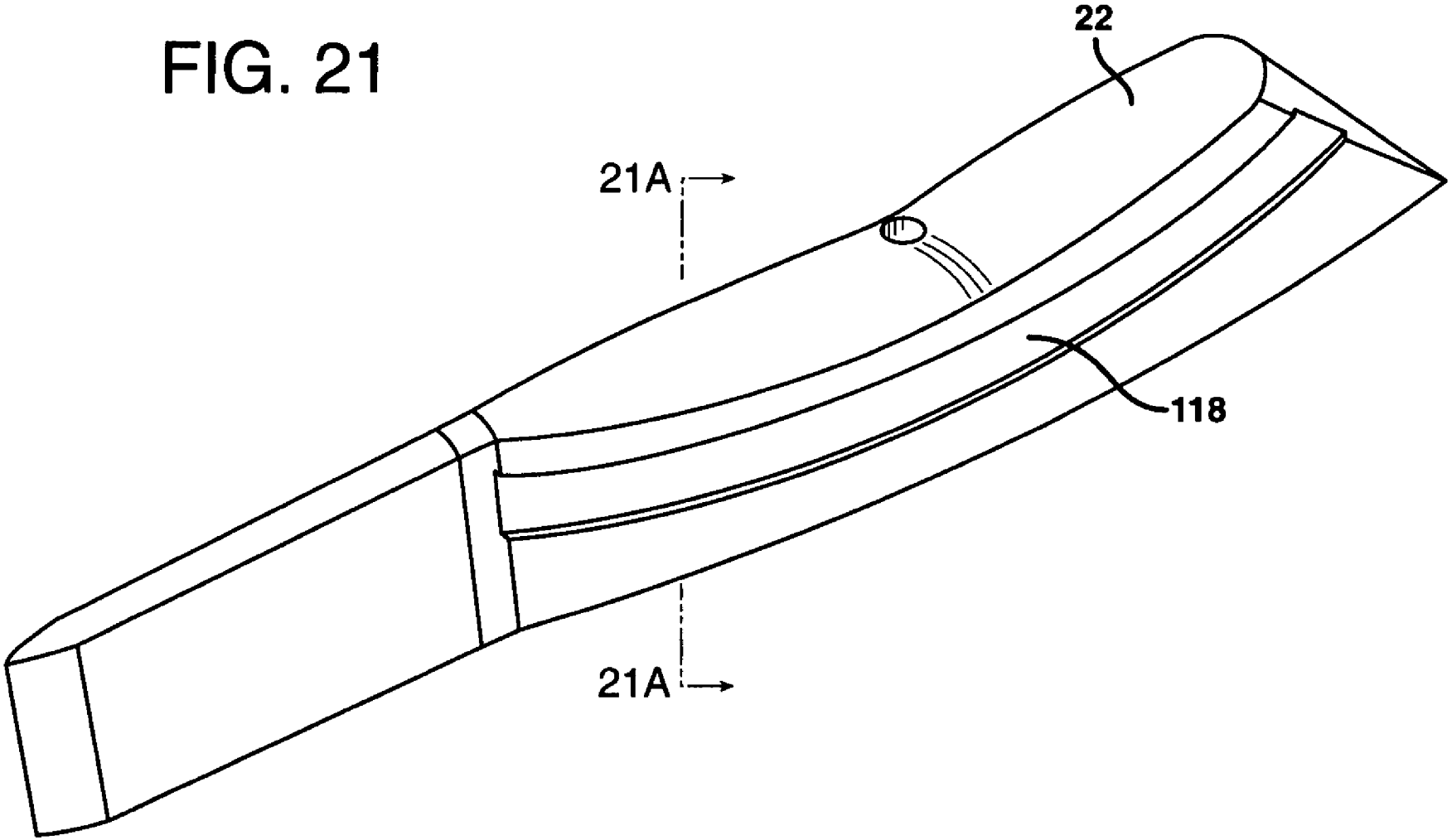
FIG. 21 is a perspective view of the inflation device shown in FIGS. 10 and 10A, with an groove in the side surfaces of the device.
Figure 21A:
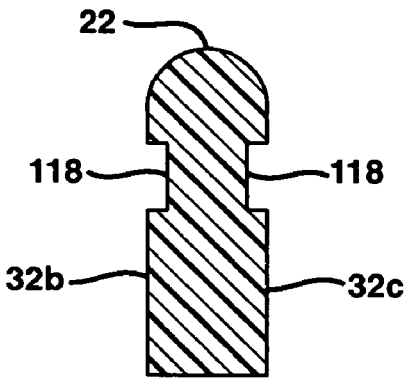
FIG. 21A is a cross-sectional view taken along lines 21A—21A in FIG. 21.
Figure 21B:
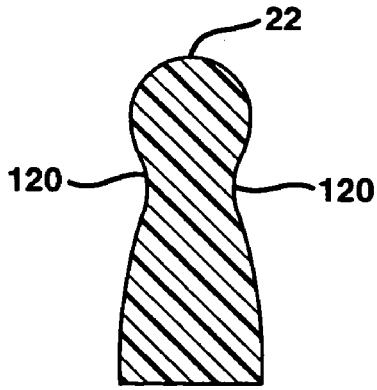
FIGS. 21B and 21C are cross-sectional views similar to FIG. 21A, but illustrate alternative grooves.
Figure 21C:
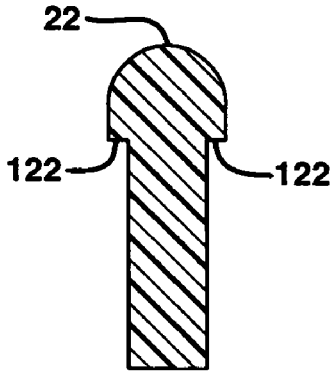

In some embodiments, it may be desirable to include a guide to direct the movement of the pressure members 24*a, b* against the inflation device, e.g., to prevent the pressure members from moving or 'wandering' upwards and downwards on side surfaces 32*a, b* (i.e., towards and away from upper surface 32*c*). A suitable guide may include a longitudinally-extending groove 118 in each of side surfaces 32*a, b* of inflation device 22, as shown in FIGS. 21 and 21A. Grooves 118 are preferably sized to accommodate the width of pressure members 24*a, b* to keep the pressure members in the track provided by grooves 118 as the pressure members move against the inflation device. Instead of a sharply notched groove as shown in FIG. 12A, a pair of curved or concave grooves 120 may be employed, as shown in FIG. 21B. If it is only necessary to prevent the pressure members 24*a, b* from moving upwards towards upper surface 32*c*, a pair of lips 122 may be employed, as shown in FIG. 21C. Lips 122 may have relatively sharp corners as shown, or may have more rounded transition.

Figure 22A:
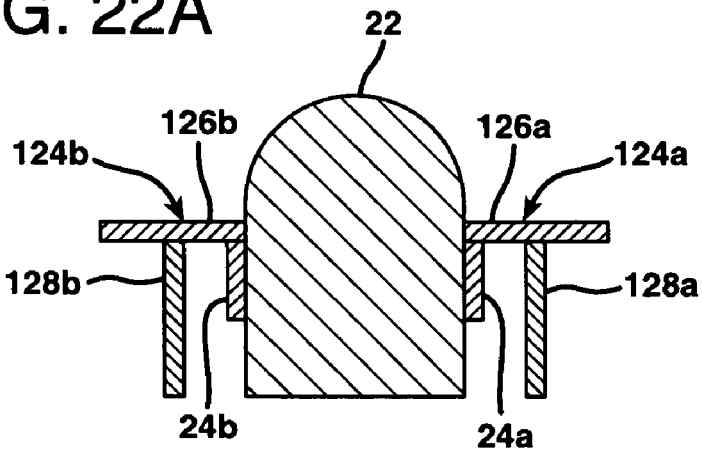
FIG. 22A is a cross-sectional view of the belt guides and inflation device, taken along lines 22A—22A in FIG. 22.
Figure 22:
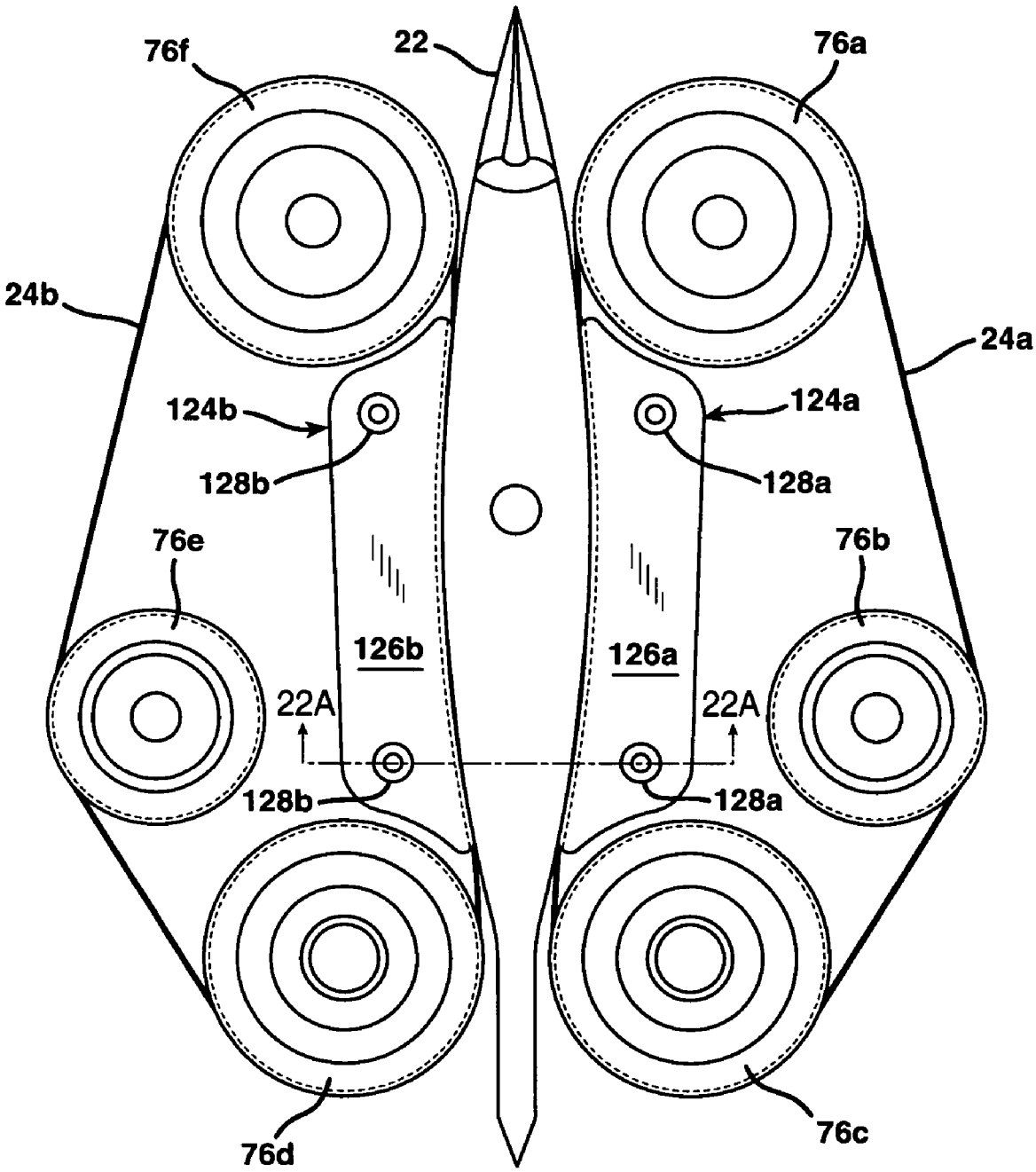
FIG. 22 is a plan view of the inflation assembly shown, e.g., in FIG. 3, with an optional pair of belt guides.

Alternatively, guides that are external to the inflation device may be employed, such as belt guides 124*a, b* (FIGS. 22 and 22A). Belt guides 124*a, b* may include respective horizontal members 126*a, b*, which are positioned above pressure members 24*a, b* to prevent the upward movement thereof. Horizontal members 126*a,b* may be secured in place, i.e., to wall 112, via mounting brackets 128*a, b* as shown.

As noted above, at least a portion of surfaces 32*a, b*, and/or *c* of inflation device 22 may have a convex shape, e.g., at surfaces 32*a, b* (see FIG. 10A). When used in conjunction with pressure members 24*a, b*, such a convex shape has been found, advantageously, to provide an increase in the compressive force exerted against film plies 18*a, b* as compared, e.g., with a non-convex surface, for a given level of tension in the pressure members. Accordingly, a relatively low level of tension in pressure members 24*a, b* may be employed while producing a relatively high degree of compression against the film plies as they pass between the pressure members and the convex surface of the inflation device.

Referring generally now to FIGS. 1–2, 5–7, 9 and 12, it may be seen that apparatus 10 may include a sealing device 14 to seal closed the openings/inflation ports 56 of the inflated containers 50, to form inflated and sealed containers 82. As shown perhaps most clearly in FIGS. 7 and 9, sealing device 14 makes a substantially longitudinal seal 84 that intersects the seals 48 near the proximal ends 60 thereof, thereby sealing closed the inflation ports 56 of each of the containers 50 to produce sealed and inflated containers 82. In this manner, gas 46 is sealed inside the containers. This essentially completes the process of making inflated containers.

Figure 9:
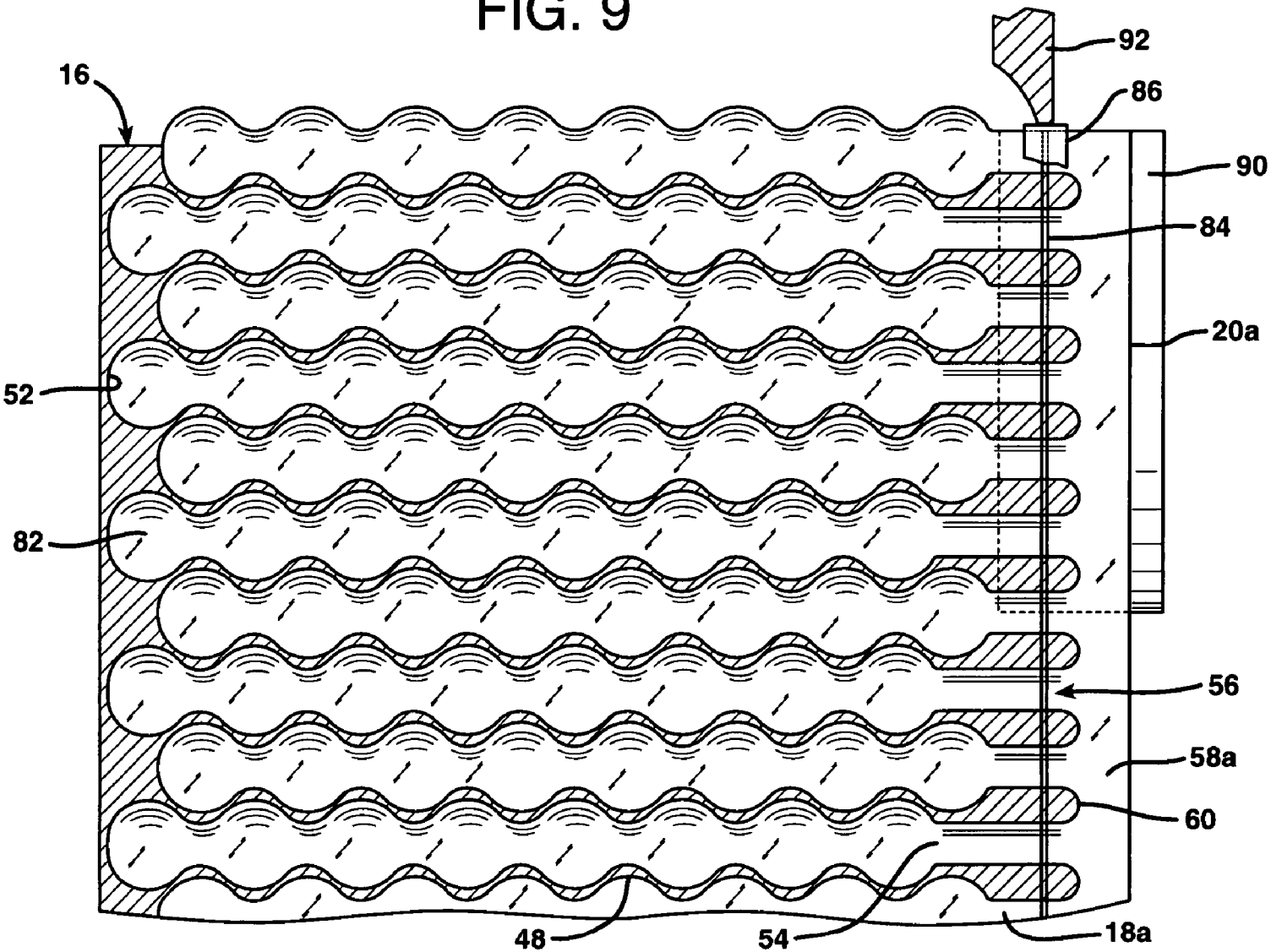
FIG. 9 is a side view of the inflatable web after being inflated and as it is being sealed closed, taken along lines 9—9 in FIG. 6.

Many types of sealing devices are suitable for making longitudinal seal 84. As illustrated, for example, sealing device 14 may be embodied by a type of device known as a 'band sealer,' which may include a flexible, heat-transfer band 86, rollers 88*a–c*, seal wheel 90, and a heating block 92 (see, e.g., FIG. 1). Heating block 92 may heated by any suitable means, such as electrical resistance heating, fluid heating, etc. When brought into contact with band 86 as shown in FIGS. 7 and 9, heat is transferred from block 92 to band 86, and then from the band to inflatable web 16 to effect longitudinal seal 84. Band 86 thus provides a heat-transfer medium between heating block 92 and inflatable web 16. In addition, band 86 is urged against seal wheel 90 via the positioning of rollers 88*a–c* and pressure from block 92 to form a compressive zone, between which film plies 18*a, b* are compressed to both facilitate the formation of longitudinal seal 84 and to assist in conveying film web 16 through apparatus 10. Seal wheel 90 may be driven by motor 94, e.g., via linkage 96 (see FIG. 2); this causes band 86 to circulate about rollers 88*a–c* in an endless loop as shown. Linkage 96 may comprise a belt as shown, or any suitable mechanical linkage, such as a chain, series of gears, etc. (this also applies to linkage 80). Instead of rollers 88*a–c* as shown, one or more of the rollers may be replaced by another device for guiding a belt or band, such as a non-rolling band guide that is grooved and/or curved to allow band 86 to slide over/past the guide.

Figure 5:
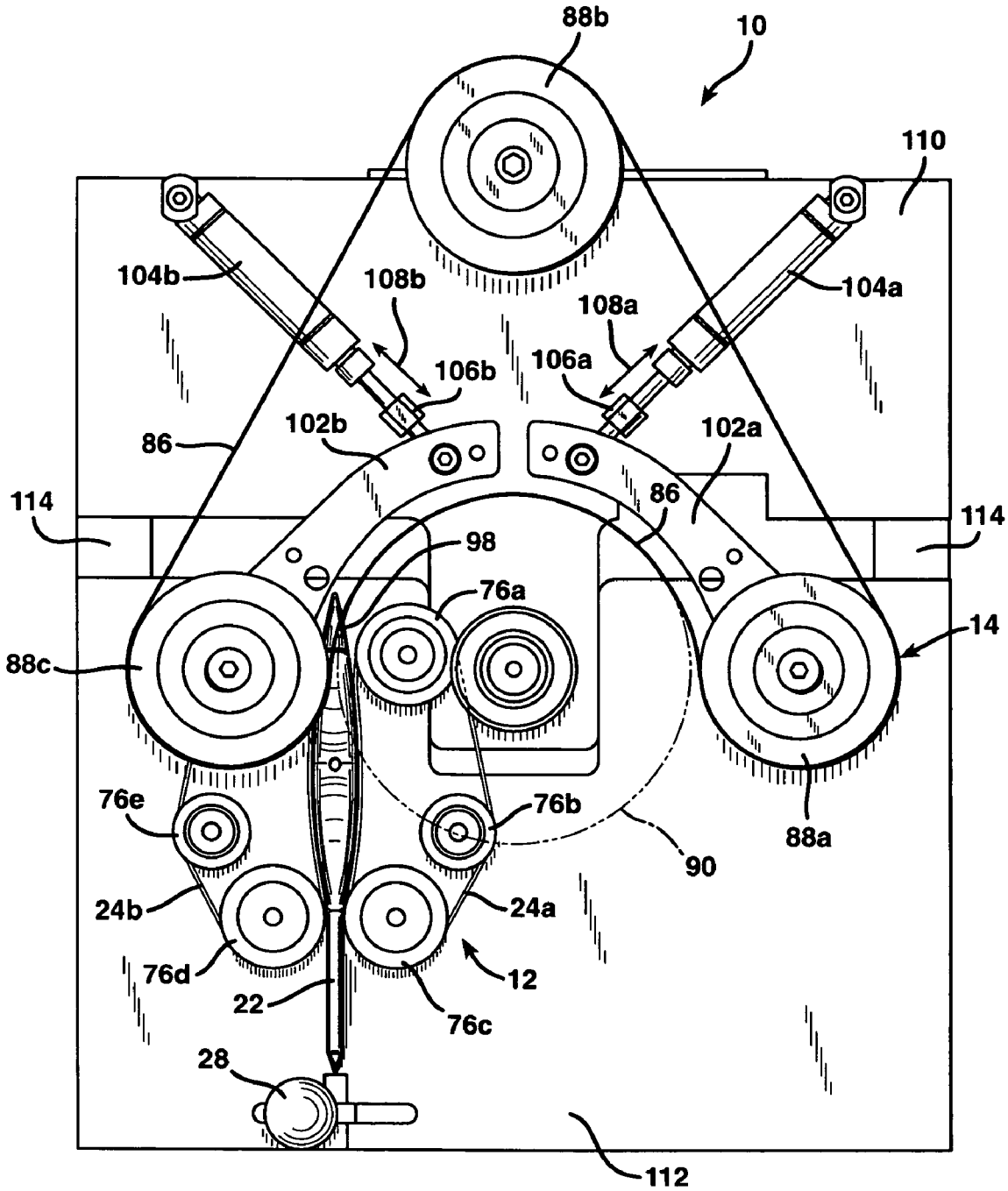
FIG. 5 is similar to the view shown in FIG. 3, but with more components of the apparatus shown.

Sealing device 14 may be spaced from and partially superimposed over inflation assembly 12. As shown perhaps most clearly in FIGS. 5 and 8, this allows the entrance 98 to sealing device 14 to be positioned, e.g., just downstream of inflation zone 44 of inflation device 22, in order to create longitudinal seal 84 immediately after inflation of containers 50. For example, entrance 98 to sealing device 14 may be placed just above the intersection of inflation zone 44 and isolation zone 64*b* of inflation device 22, as shown in FIG. 8. In FIG. 5, seal wheel 90 is shown in phantom for clarity. In FIG. 6, an alternative configuration is shown, in which sealing device 14 is positioned further downstream than as shown in FIG. 5, so that entrance 98 is downstream of isolation zone 64*b*.

If desired, sealing device 14 may further include a cooling block 100, which may be positioned, e.g., just downstream of heating block 92 as shown. In certain applications, a cooling block 100 may be desirable in order to facilitate cooling and stabilization of the newly-formed seal 84 by maintaining pressure on the inner surface of heat-transfer band 86 while also providing a heat sink to draw heat away from the band and, therefore, away from the newly-formed seal 84. Cooling block 100 may comprise any standard heat-removal device relying, e.g., on natural or forced-air convection, and may include, e.g., cooling fins, an interior path through which cool air or liquid may be circulated, etc., depending upon the particular cooling needs of the end-use application.

As shown, heating and cooling blocks 92, 100 may be affixed to respective mounting plates 102*a, b* (FIG. 5). Mounting plates 102*a, b* may be movable, e.g., pivotally movable, so that heating and cooling blocks 92, 100 can be moved into and out of contact with heat-transfer band 86 as desired, e.g., to facilitate changing of the band and/or to avoid melting the inflatable web when apparatus 10 is in an idle mode, i.e., temporarily not producing inflated containers such that inflatable web 16 is stationary. Plates 102*a, b* may pivot from the same axis upon which rollers 88*a, c* rotate as shown, and may be moved/pivoted by respective actuators 104*a, b*. The distal portions 106*a, b* of actuators 104*a, b* may translate in the direction of arrows 108*a, b* (see FIG. 5). This causes mounting plates 102*a, b*, and therefore heating and cooling blocks 92, 100, respectively, to pivot into and out of contact with heat-transfer band 86. Actuators 104*a, b* may be, e.g., piston or screw-type actuators, and may be actuated, e.g., pneumatically, hydraulically, electrically, mechanically, magnetically, electro-magnetically, etc., as desired.

Referring now to FIG. 2, it may be seen that sealing device 14 may be positioned at an angle "θ" relative to the inflation assembly 12. In other words, the travel path that inflatable web 16 follows through sealing device 14 may be tilted forward at an angle θ relative to the travel path the web follows through the inflation assembly 12, as viewed from the side in FIG. 2. This orientation of the overall web travel path has been found to facilitate the movement of the inflatable web through the apparatus 10 by accommodating the changing shape of the web as it is inflated. That is, because the flanges 58*a, b* of the web 16 are maintained in a stretched/taught state by inflation assembly 12 and sealing device 14, while the distal ends of the containers 50 are unconstrained, the web tends to curve away from the inflation assembly 12 as it inflates. When following an essentially 180° travel path through the sealing device 14 as shown, it has been found that an outward tilt of the sealing device allows the web to follow its natural path while being sealed. Allowing the web to follow its natural path during sealing has been found to result in a more consistent seal 84.

The angle θ may be any angle that best follows the path of the inflatable web employed in apparatus 10, and may range, e.g. from about 0° to about 20°, such as from about 1° to about 10° or about 2° to about 6°. In some applications, for instance, a tilt of 3° to 5° has been found suitable. The tilt may be achieved by affixing all or some of the components of sealing device 14 to mounting wall 110, and the components of inflation assembly 12 to mounting wall 112, and securing the walls 110, 112 together with wedge-shaped mounting brackets 114 (only one shown in FIG. 2), so that wall 110 is at angle θ relative to wall 112 as shown. As also shown, rollers 88*a, c* can be mounted to wall 112, at an angle θ thereto, while the other components of sealing device 14 are mounted to angled wall 110. A further alternative is to affix a second wall to wall 110 so that it is outboard of and parallel to wall 110, and mount rollers 88*a–c* thereto.

It is to be understood that the illustrated sealing device 14 is merely one way to provide longitudinal seal 84, and that numerous alternative heat-seal mechanisms may be used. For instance, the illustrated 180° travel path through sealing device 14 is not a requirement; travel paths of lesser or greater degrees may also be employed, as may linear travel paths.

An example of an alternative sealing device which may be used to form longitudinal seal 84 is a type of device known as a "drag sealer," which includes a stationary heating element that is placed in direct contact with a pair of moving film plies to create a continuous longitudinal seal. Such devices are disclosed, e.g., in U.S. Pat. Nos. 6,550,229 and 6,472,638, the disclosures of which are hereby incorporated herein by reference. A further alternative device for producing a continuous longitudinal edge seal, which may be suitably employed for sealing device 14, utilizes a heating element that is completely wrapped about the outer circumference of a cylinder, as disclosed in U.S. Pat. No. 5,376,219, the disclosure of which is hereby incorporated herein by reference.

Figure 12:
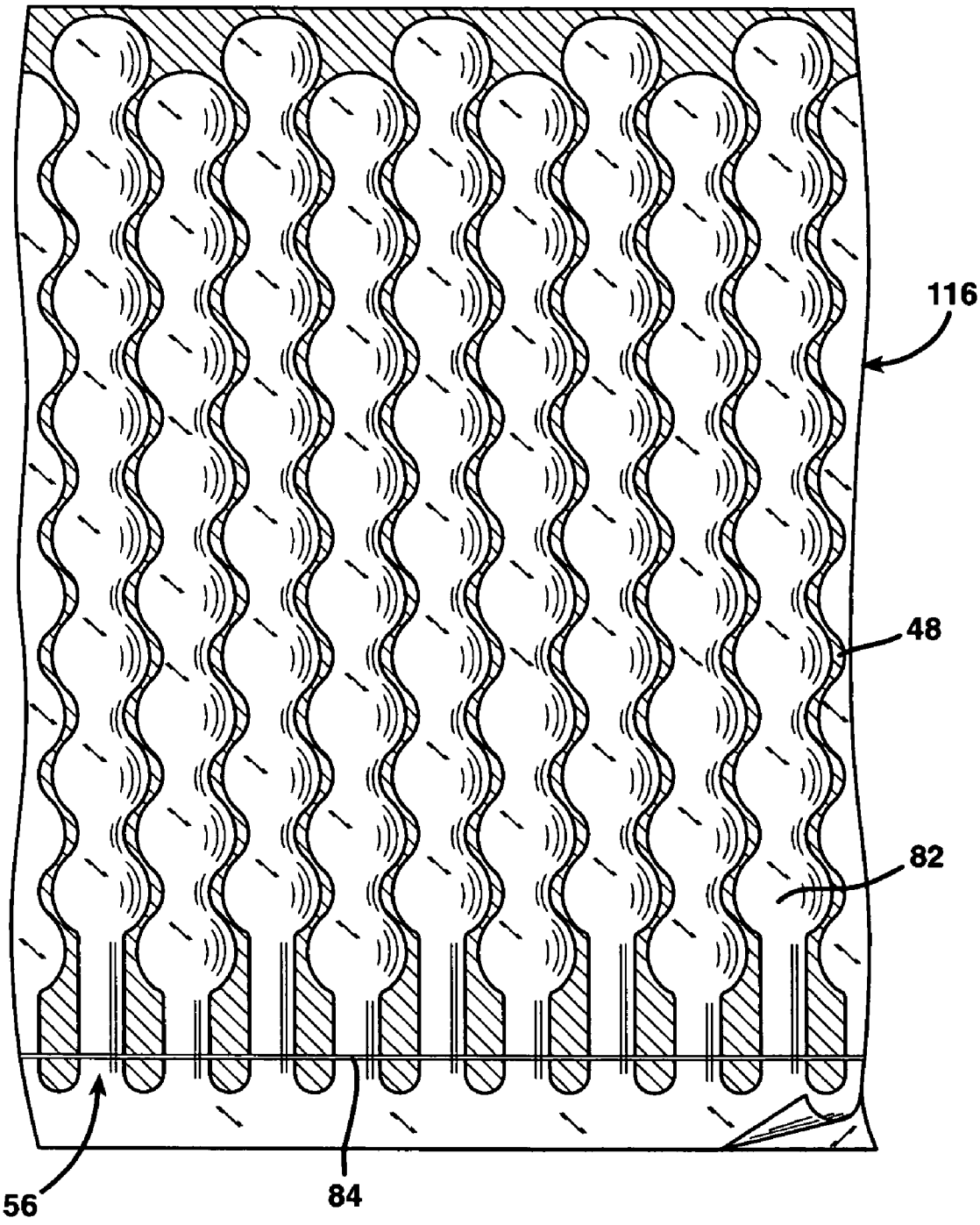
FIG. 12 is a plan view of the web as shown in FIG. 11 after being inflated and sealed closed.

FIG. 12 is a plan view of the web 16 as shown in FIG. 11, but with inflated and sealed containers 82 to form a completed cushion 116. The completed cushion 116 may be collected in a basket or other suitable container, or wound on a roll until needed for use. Alternatively, sections of desired length of the completed cushion 116 may be used as it is produced. Predetermined lengths of cushion 116 may be cut with a suitable cutting instrument, e.g., a knife or scissors. Alternatively, web 16 may include one or more lines of weakness, e.g., perforation lines (not shown), that may be spaced along predetermined lengths of the web and generally follow the transverse seals 48. Such perforation lines would allow section(s) of completed cushion 116 of desired length to be removed for individual use without the need for a cutting instrument, and are described in further detail in the above-referenced patents. As an alternative to providing perforation lines or using a cutting instrument, a severing device may be included or associated with apparatus 10 to sever sections of completed cushioning material from the web, e.g., via mechanical means and/or heat, wherein such sections may have any desired length of fixed or variable dimension.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention.

What is claimed is:

1. An inflation device for introducing gas into moving inflatable webs of the type that are conveyed in a forward direction along a path of travel and comprise a pair of juxtaposed film plies and a pair of opposing film edges, each film edge being associated with a respective film ply, said inflation device comprising:

a. a body having a longitudinal dimension, a transverse dimension, and a web-contact region in which said inflation device makes contact with opposing surfaces of the juxtaposed film plies, said body adapted to assume a position in which its longitudinal dimension is substantially in alignment with at least part of the web travel path, said body having at least one increase in peripheral transverse surface distance along the longitudinal dimension of said body in the forward direction of web travel, said peripheral transverse surface distance being measured (i) in a direction that is substantially transverse to the longitudinal dimension of said body and (ii) from one of the opposing film edges to the other within the web-contact region of said body; and b. a passage within said body through which gas may flow, said passage having a termination point within the web-contact region to form an inflation zone wherein gas may be introduced into the inflatable web, wherein the peripheral transverse surface distance of said inflation zone is less than that of other portions of said inflation device.

2. The inflation device of claim 1, wherein said body has a contoured surface.

3. The inflation device of claim 2, wherein at least a portion of said surface has a convex shape.

4. The inflation device of claim 2, wherein at least a portion of said surface has a concave shape.

5. The inflation device of claim 1, wherein said body has at least one change in transverse width or height along the longitudinal dimension of said body.

6. The inflation device of claim 1, further including at least one isolation zone having a peripheral transverse surface distance that is greater than that of said inflation zone.

7. The inflation device of claim 6, wherein a. said device includes at least two isolation zones; and b. said inflation zone is disposed between said isolation zones.

8. An inflation device for introducing gas into moving inflatable webs of the type that are conveyed in a forward direction along a path of travel and comprise a pair of juxtaposed film plies and a pair of opposing film edges, each film edge being associated with a respective film ply, said inflation device comprising:

a. a body having a longitudinal dimension, a transverse dimension, and a web-contact region in which said inflation device makes contact with opposing surfaces of the juxtaposed film plies, said body adapted to assume a position in which its longitudinal dimension is substantially in alignment with at least part of the web travel path, said body having at least one increase in peripheral transverse surface distance along the longitudinal dimension of said body in the forward direction of web travel, said peripheral transverse surface distance being measured (i) in a direction that is substantially transverse to the longitudinal dimension of said body and (ii) from one of the opposing film edges to the other within the web-contact region of said body;

b. a passage within said body through which gas may flow, said passage having a termination point within the web-contact region to form an inflation zone wherein gas may be introduced into the inflatable web; and c. at least one isolation zone, said isolation zone being associated with said body and having a peripheral transverse surface distance that is greater than that of said inflation zone.

9. The inflation device of claim 8, wherein a. said device includes at least two isolation zones; and b. said inflation zone is disposed between said isolation zones.

10. An inflation assembly for introducing gas into moving inflatable webs of the type that are conveyed in a forward direction along a path of travel and comprise a pair of juxtaposed film plies and a pair of opposing film edges, each film edge being associated with a respective film ply, said inflation assembly comprising:

a. an inflation device, comprising 1) a body having a longitudinal dimension, a transverse dimension, and a web-contact region in which said inflation device makes contact with opposing surfaces of the juxtaposed film plies, said body adapted to assume a position in which its longitudinal dimension is substantially in alignment with at least part of the web travel path, said body having at least one increase in peripheral transverse surface distance along the longitudinal dimension of said body in the forward direction of web travel, said peripheral transverse surface distance being measured (i) in a direction that is substantially transverse to the longitudinal dimension of said body and (ii) from one of the opposing film edges to the other within the web-contact region of said body, and 2) a passage within said body through which gas may flow, said passage having a termination point within the web-contact region to form an inflation zone wherein gas may be introduced into the inflatable web, wherein the peripheral transverse surface distance of said inflation zone is less than that of other portions of said inflation device; and b. at least one pressure member capable of exerting a compressive force against at least one of the film plies such that the film ply is compressed between said at least one pressure member and a surface of said inflation device.

11. The inflation assembly of claim 10, further including a second pressure member that exerts a compressive force against the other film ply.

12. The inflation assembly of claim 10, wherein said pressure member effects relative motion between the inflatable web and said inflation device.

13. The inflation assembly of claim 10, wherein said pressure member comprises a rotating belt.

14. The inflation assembly of claim 10, wherein said inflation device further includes at least one isolation zone having a peripheral transverse surface distance that is greater than that of said inflation zone.

15. The inflation assembly of claim 14, wherein said inflation device and said pressure member cooperate to substantially prevent gas flow into portions of the inflatable web that are in contact with said isolation zone.

16. The inflation assembly of claim 14, wherein a. said inflation device includes at least two isolation zones; and b. said inflation zone is disposed between said isolation zones.

17. The inflation assembly of claim 10, wherein said body has a contoured surface.

18. The inflation assembly of claim 17, wherein at least a portion of said surface has a convex shape.

19. The inflation assembly of claim 17, wherein at least a portion of said surface has a concave shape.

20. The inflation assembly of claim 10, wherein said body has at least one change in transverse width or height along the longitudinal dimension of said body.

21. The inflation assembly of claim 10, wherein a. said pressure member is adapted to move against said inflation device, and b. said inflation assembly further includes a guide to direct the movement of said pressure member against said inflation device.

22. An inflation assembly for introducing gas into moving inflatable webs of the type that are conveyed in a forward direction along a path of travel and comprise a pair of juxtaposed film plies and a pair of opposing film edges, each film edge being associated with a respective film ply, said inflation assembly comprising:

a. an inflation device, comprising 1) a body having a longitudinal dimension, a transverse dimension, and a web-contact region in which said inflation device makes contact with opposing surfaces of the juxtaposed film plies, said body adapted to assume a position in which its longitudinal dimension is substantially in alignment with at least part of the web travel path, said body having at least one increase in peripheral transverse surface distance along the longitudinal dimension of said body in the forward direction of web travel, said peripheral transverse surface distance being measured (i) in a direction that is substantially transverse to the longitudinal dimension of said body and (ii) from one of the opposing film edges to the other within the web-contact region of said body, 2) a passage within said body through which gas may flow, said passage having a termination point within the web-contact region to form an inflation zone wherein gas may be introduced into the inflatable web, and 3) at least one isolation zone, said isolation zone being associated with said body and having a peripheral transverse surface distance that is greater than that of said inflation zone; and b. at least one pressure member capable of exerting a compressive force against at least one of the film plies such that the film ply is compressed between said at least one pressure member and a surface of said inflation device.

23. The inflation assembly of claim 22, wherein said inflation device and said pressure member cooperate to substantially prevent gas flow into portions of the inflatable web that are in contact with said isolation zone.

24. The inflation assembly of claim 22, wherein a. said inflation device includes at least two isolation zones; and b. said inflation zone is disposed between said isolation zones.

25. An apparatus for making inflated containers from a moving film web having two juxtaposed film plies, the juxtaposed film plies including a pair of opposing film edges, each film edge being associated with a respective film ply, and a series of containers between the film plies, each container having at least one opening therein, said apparatus comprising:

a. a mechanism that conveys the film web in a forward direction along a path of travel;

b. an inflation assembly for inflating the containers by introducing a stream of gas into the openings thereof, said inflation assembly comprising:

1) an inflation device, comprising (a) a body having a longitudinal dimension, a transverse dimension, and a web-contact region in which said inflation device makes contact with opposing surfaces of the juxtaposed film plies, said body adapted to assume a position in which its longitudinal dimension is substantially in alignment with at least part of the web travel path, said body having at least one increase in peripheral transverse surface distance along the longitudinal dimension of said body in the forward direction of web travel, said peripheral transverse surface distance being measured (i) in a direction that is substantially transverse to the longitudinal dimension of said body and (ii) from one of the opposing film edges to the other within the web-contact region of said body, and (b) a passage within said body through which gas may flow, said passage having a termination point within the web-contact region to form an inflation zone wherein gas may be introduced into the inflatable web, wherein the peripheral transverse surface distance of said inflation zone is less than that of other portions of said inflation device, and 2) at least one pressure member capable of exerting a compressive force against at least one of the film plies such that the film ply is compressed between said at least one pressure member and a surface of said inflation device; and c. a sealing device for sealing closed the openings of the inflated containers.

26. The apparatus of claim 25, wherein said inflation device further includes at least one isolation zone having a peripheral transverse surface distance that is greater than that of said inflation zone.

27. The apparatus of claim 26, wherein said pressure member and said isolation zone cooperate to direct the gas stream into the openings of containers that are adjacent to said inflation zone.

28. An apparatus for making inflated containers from a moving film web having two juxtaposed film plies, the juxtaposed film plies including a pair of opposing film edges, each film edge being associated with a respective film ply, and a series of containers between the film plies, each container having at least one opening therein, said apparatus comprising:

a. a mechanism that conveys the film web in a forward direction along a path of travel;

b. an inflation assembly for inflating the containers by introducing a stream of gas into the openings thereof, said inflation assembly comprising:

1) an inflation device, comprising (a) a body having a longitudinal dimension, a transverse dimension, and a web-contact region in which said inflation device makes contact with opposing surfaces of the juxtaposed film plies, said body adapted to assume a position in which its longitudinal dimension is substantially in alignment with at least part of the web travel path, said body having at least one increase in peripheral transverse surface distance along the longitudinal dimension of said body in the forward direction of web travel, said peripheral transverse surface distance being measured (i) in a direction that is substantially transverse to the longitudinal dimension of said body and (ii) from one of the opposing film edges to the other within the web-contact region of said body, (b) a passage within said body through which gas may flow, said passage having a termination point within the web-contact region to form an inflation zone wherein gas may be introduced into the inflatable web, and (c) at least one isolation zone, said isolation zone being associated with said body and having a peripheral transverse surface distance that is greater than that of said inflation zone, and 2) at least one pressure member capable of exerting a compressive force against at least one of the film plies such that the film ply is compressed between said at least one pressure member and a surface of said inflation device; and c. a sealing device for sealing closed the openings of the inflated containers.

29. The apparatus of claim 28, wherein said pressure member and said isolation zone cooperate to direct the gas stream into the openings of containers that are adjacent to said inflation zone.

30. The inflation assembly of claim 28, wherein said inflation device and said pressure member cooperate to substantially prevent gas flow into portions of the inflatable web that are in contact with said isolation zone.

31. The inflation assembly of claim 28, wherein a. said inflation device includes at least two isolation zones; and b. said inflation zone is disposed between said isolation zones.

* * * * *